US010002581B2

(12) United States Patent
Park

(10) Patent No.: US 10,002,581 B2
(45) Date of Patent: Jun. 19, 2018

(54) LIQUID CRYSTAL DISPLAY AND A DRIVING METHOD THEREOF

(71) Applicant: SAMSUNG DISPLAY CO., LTD., Yongin-si, Gyeonggi-do (KR)

(72) Inventor: Su Hyeong Park, Gyeongju-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 196 days.

(21) Appl. No.: 14/934,481

(22) Filed: Nov. 6, 2015

(65) Prior Publication Data

US 2016/0322011 A1 Nov. 3, 2016

(30) Foreign Application Priority Data

Apr. 30, 2015 (KR) ..... 10-2015-0062039

(51) Int. Cl.
*G09G 3/36* (2006.01)

(52) U.S. Cl.
CPC ..... *G09G 3/3685* (2013.01); *G09G 3/3611* (2013.01); *G09G 2300/0434* (2013.01); *G09G 2310/027* (2013.01); *G09G 2310/0259* (2013.01); *G09G 2310/0289* (2013.01)

(58) Field of Classification Search
CPC ... G09G 2300/0434; G09G 2310/0248; G09G 2310/0259; G09G 2310/027; G09G 2310/0289; G09G 2330/021; G09G 3/3611; G09G 3/3614; G09G 3/3685; G09G 3/3688
See application file for complete search history.

(56) References Cited

U.S. PATENT DOCUMENTS

| | | | | |
|---|---|---|---|---|
| 7,518,588 | B2 | 4/2009 | Lin | |
| 7,956,854 | B2 | 6/2011 | Hashimoto | |
| 9,275,583 | B2 * | 3/2016 | Kim | G09G 3/3275 |
| 2007/0018923 | A1 * | 1/2007 | Yokota | G09G 3/3688 345/89 |
| 2008/0136806 | A1 * | 6/2008 | Lee | G09G 3/3688 345/212 |

(Continued)

FOREIGN PATENT DOCUMENTS

| | | |
|---|---|---|
| JP | 2012-058692 | 3/2012 |
| KR | 1020080053600 | 6/2008 |

(Continued)

OTHER PUBLICATIONS

B.D. Choi et al., "A Low-Power Data Driver With Stepwise Driving Method for TFT-LCDs", SID 01 Digest, 2001, pp. 273-275.

*Primary Examiner* — Patrick Edouard
*Assistant Examiner* — Peijie Shen
(74) *Attorney, Agent, or Firm* — F. Chau & Associates, LLC

(57) ABSTRACT

A liquid crystal display includes a liquid crystal panel which includes a plurality of pixels and a plurality of data lines connected to the plurality of pixels and a data driver which applies data voltages having different polarities to adjacent data lines among the plurality of data lines and performs a first charge sharing to short the data lines having the different polarities and a second charge sharing to short the data lines having the same polarity, wherein the voltage of at least one of the data lines is step-wisely changed by the second charge sharing.

17 Claims, 29 Drawing Sheets

(56) References Cited

U.S. PATENT DOCUMENTS

| | | | | |
|---|---|---|---|---|
| 2009/0002302 | A1* | 1/2009 | Koo | G09G 3/3614<br>345/89 |
| 2011/0057914 | A1* | 3/2011 | Nam | G09G 3/3648<br>345/211 |
| 2012/0169788 | A1* | 7/2012 | Jang | G09G 3/3614<br>345/690 |
| 2013/0083093 | A1* | 4/2013 | Kim | G09G 3/3275<br>345/690 |
| 2013/0120334 | A1* | 5/2013 | Kim | G09G 3/3688<br>345/208 |
| 2013/0127806 | A1* | 5/2013 | Wu | G09G 3/3688<br>345/211 |
| 2014/0320464 | A1* | 10/2014 | Ryu | G09G 3/3688<br>345/204 |
| 2015/0123961 | A1* | 5/2015 | Park | G09G 3/3614<br>345/212 |
| 2015/0287374 | A1* | 10/2015 | Chen | G09G 3/3688<br>345/98 |

FOREIGN PATENT DOCUMENTS

| | | |
|---|---|---|
| KR | 1020110026794 | 3/2011 |
| KR | 1020130051806 | 5/2013 |

* cited by examiner

FIG. 6

Logic 1

| SW1 (Φ1) | wx | | | |
|---|---|---|---|---|
| yz | 00 | 01 | 11 | 10 |
| 00 | | 1 | 1 | 1 |
| 01 | 1 | | | |
| 11 | | | | |
| 10 | | | | |

Logic 2

| SW1 (Φ3) | wx | | | |
|---|---|---|---|---|
| yz | 00 | 01 | 11 | 10 |
| 00 | | | | |
| 01 | | | | |
| 11 | 1 | | | |
| 10 | 1 | | | |

Logic 3

| SW2 (Φ2) | wx | | | |
|---|---|---|---|---|
| yz | 00 | 01 | 11 | 10 |
| 00 | | | 1 | 1 |
| 01 | | | 1 | 1 |
| 11 | 1 | 1 | | |
| 10 | 1 | 1 | | |

Logic 4

| SW3 (Φ3) | wx | | | |
|---|---|---|---|---|
| yz | 00 | 01 | 11 | 10 |
| 00 | | | 1 | |
| 01 | | | 1 | |
| 11 | | | | |
| 10 | | | | |

Logic 5

| SW3 (Φ1) | wx | | | |
|---|---|---|---|---|
| yz | 00 | 01 | 11 | 10 |
| 00 | | | | |
| 01 | | | | |
| 11 | 1 | 1 | | 1 |
| 10 | | | 1 | |

LIQUID CRYSTAL DISPLAY AND A DRIVING METHOD THEREOF

CROSS-REFERENCE TO RELATED APPLICATION

This application claims priority to Korean Patent Application No. 10-2015-0062039 filed in the Korean Intellectual Property Office on Apr. 30, 2015, the disclosure of which is incorporated by reference herein in its entirety.

TECHNICAL FIELD

The present invention relates to a liquid crystal display and a driving method thereof.

DESCRIPTION OF THE RELATED ART

A liquid crystal display, which is one of the most common types of flat panel displays, includes two display panels with field generating electrodes, such as a pixel electrode and a common electrode, formed thereon, and a liquid crystal layer interposed between the display panels. The liquid crystal display generates electric fields in a liquid crystal layer by applying a voltage to the field generating electrodes, and determines the direction of liquid crystal molecules in the liquid crystal layer by using the generated electric field, thereby controlling polarization of incident light to display images.

The liquid crystal display performs inversion driving to change a direction of an electric field which is applied to the liquid crystal layer, thereby preventing the liquid crystal layer from being degraded. To perform inversion driving, a polarity of the data voltage which is applied to the data line is continuously changed at a predetermined cycle. However, this may cause power consumption of the liquid crystal display to be increased.

SUMMARY

An exemplary embodiment of the present invention provides a liquid crystal display including a liquid crystal panel which includes a plurality of pixels and a plurality of data lines connected to the plurality of pixels and a data driver which applies data voltages having different polarities to adjacent data lines among the plurality of data lines and performs a first charge sharing to short the data lines having the different polarities and a second charge sharing to short the data lines having the same polarity, wherein the voltage of at least one of the data lines is step-wisely changed by the second charge sharing.

The data driver may further include a plurality of positive voltage switches which connects a plurality of positive voltage capacitors to the at least one data line having a positive voltage to perform the second charge sharing and a plurality of negative voltage switches which connects a plurality of negative voltage capacitors to the at least one data line having a negative voltage to perform the second charge sharing.

The data driver may further include a digital-to-analog converter (DAC) unit which converts a digital image signal into an analog data voltage, an amplifier which amplifies the data voltage, and a multiplexer (MUX) unit which adjusts the data voltage in accordance with a polarity to be applied to the at least one data line in response to an inversion signal.

The plurality of positive voltage switches and the plurality of negative voltage switches may be disposed next to the MUX unit.

The plurality of positive voltage switches and the plurality of negative voltage switches may be disposed in each of the plurality of data lines.

The data driver may further include a path selecting unit which is disposed between the plurality of positive voltage switches and the plurality of negative voltage capacitors and between the plurality of negative voltage switches and the plurality of positive voltage capacitors.

The plurality of positive voltage switches may be disposed in at least one of odd data lines and even data lines and the plurality of negative voltage switches may be disposed in at least one of the other odd data lines and even data lines.

The plurality of positive voltage capacitors and the plurality of negative voltage capacitors may have different voltages.

The data driver may further include a most significant bit (MSB) latch which stores 2 bits of an MSB (MSB 2 bit) of image data and outputs the MSB 2 bit of the image data corresponding to a stored gate signal of a previous row, and the MSB 2 bit of the image data corresponding to a gate signal in a present row, a variation detecting unit which compares the MSB 2 bit of the image data corresponding to the gate signal of the previous row with the MSB 2 bit of the image data corresponding to the gate signal of the present row to detect a voltage change in the plurality of data lines, and a switch controller which generates a switch control signal to control the plurality of positive voltage switches and the plurality of negative voltage switches which connect the plurality of positive voltage capacitors and the plurality of negative voltage capacitors to the plurality of data lines in accordance with the voltage change.

The variation detecting unit may include a plurality of logic circuits which outputs a plurality of logic values to control the plurality of positive voltage switches and the plurality of negative voltage switches in accordance with a bit value output from the MSB latch.

The switch controller may include a first AND unit which receives a first logic value and a first phase signal which divides a plurality of sections in which the at least one data line is step-wisely changed, a second AND unit which receives a second logic value and a third phase signal which divides the plurality of sections, a first OR unit which compares output values of the first AND unit and the second AND unit to output 1 when at least one of the output values is 1, and a third AND unit which receives an output value of the first OR unit and an ACS signal to output a first switch control signal, wherein the ACS signal instructs the second charge sharing to be performed.

The third AND unit may further receive a polarity inversion signal to output the first switch control signal.

The switch controller may further include a fourth AND unit which receives the output value of the first OR unit, the ACS signal, and a reverse signal of the polarity inversion signal to output the second switch control signal.

The switch controller may further include a fifth AND unit which receives a third logic value and a second phase signal which divides the plurality of sections and a sixth AND unit which receives an output value of the fifth AND unit and the ACS signal to output the second switch control signal.

The sixth AND unit may further receive a polarity inversion signal to output the second switch control signal.

The switch controller further includes a seventh AND unit which may receive an output value of the fifth AND unit, the ACS signal, and a reverse signal of the polarity inversion signal to output a third switch control signal.

An exemplary embodiment of the present invention provides a driving method of a liquid crystal display including applying data voltages having different polarities to adjacent data lines among a plurality of data lines connected to a plurality of pixels, performing a first charge sharing which shorts the data lines having different polarities from each other; and performing a second charge sharing which shorts the data lines having the same polarity from each other, wherein the voltage of at least one of the data lines is step-wisely changed by the second charge sharing.

The first charge sharing and the second charge sharing may not overlap.

The driving method may further include comparing an MSB 2 bit of image data corresponding to a gate signal of a previous row with an MSB 2 bit of image data corresponding to a gate signal of a present row to detect a voltage change of the at least one data line during the second charge sharing.

An exemplary embodiment of the present invention provides a liquid crystal display including: a plurality of data lines; and a data driver which shorts the data lines having different polarities and shorts the data lines having the same polarity, wherein the data lines having the different polarities are shorted in a first charge sharing and the data lines having the same polarity are shorted in a second charge sharing, wherein the data driver includes a first switch for the first charge sharing and a plurality of second switches for the second charge sharing, wherein the plurality of second switches increase or decrease a voltage of at least one of the data lines during the second charge sharing.

BRIEF DESCRIPTION OF THE DRAWINGS

FIG. 6 is a table illustrating an output value of a logic circuit included in a variation detecting unit of FIG. 5, according to an exemplary embodiment of the present invention.

DETAILED DESCRIPTION OF THE EMBODIMENTS

Figure 1:
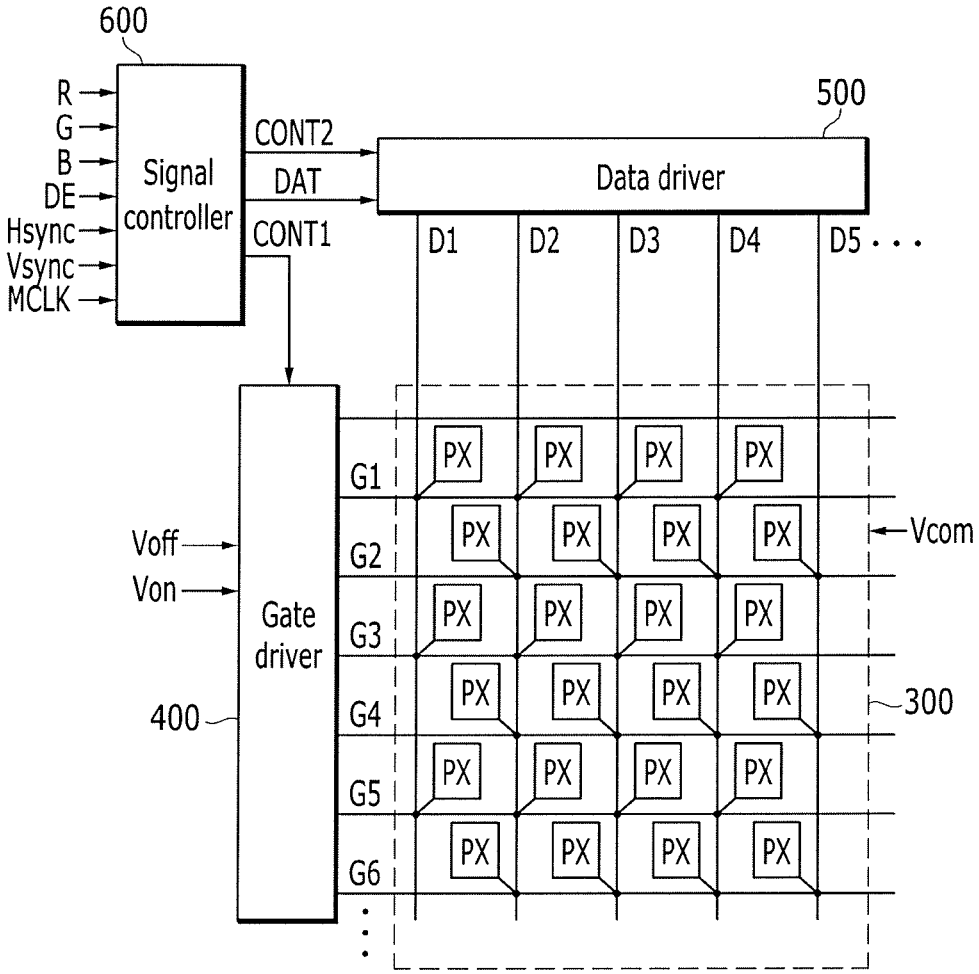
FIG. 1 is a block diagram illustrating a liquid crystal display according to an exemplary embodiment of the present invention.

Hereinafter, exemplary embodiments of the present invention will be described more fully with reference to the accompanying drawings. However, the described embodiments may be modified in various different ways, and should not be construed as limited to the embodiments disclosed herein.

Like reference numerals designate may like elements throughout the specification.

It will be understood that when an element is referred to as being "coupled" to another element, the element may be "directly coupled" to the other element or "electrically coupled" to the other element through a third element. Now, a liquid crystal display according to an exemplary embodiment of the present invention will be described in detail with reference to FIGS. 1 and 2.

Figure 2:
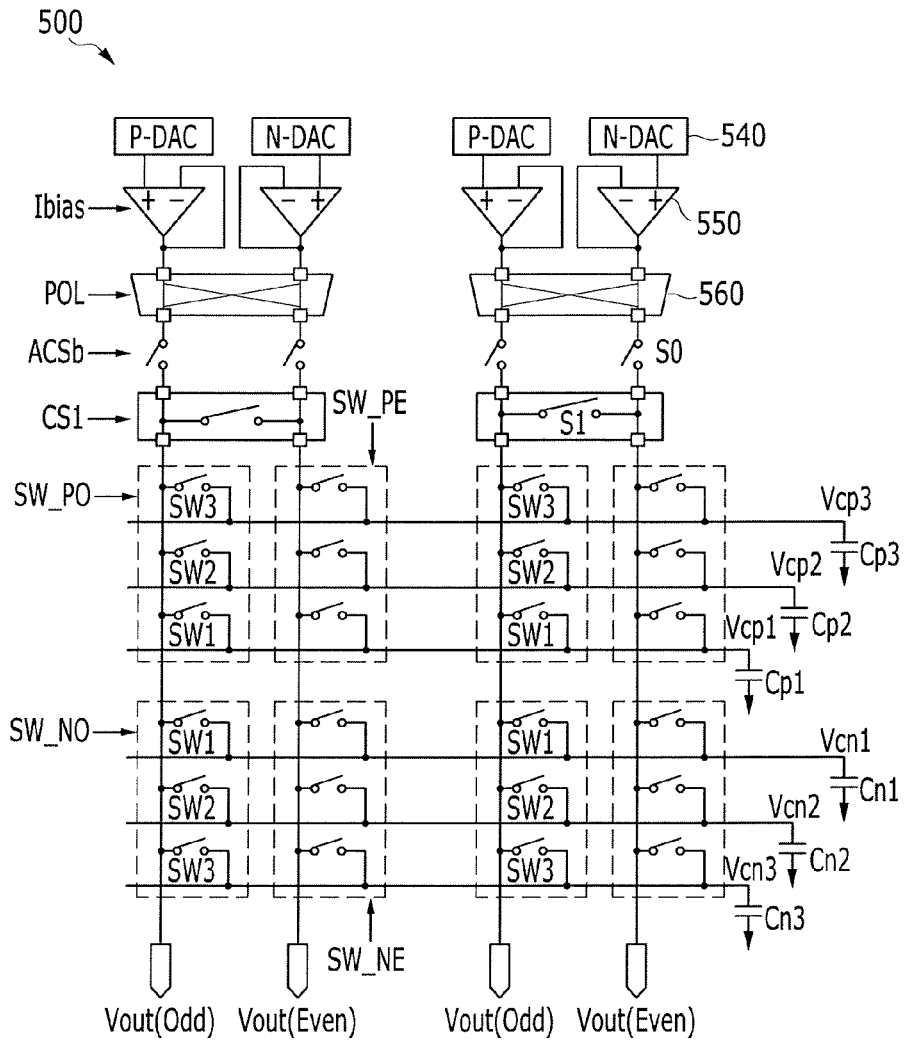
FIG. 2 is a block diagram illustrating a data driver of a liquid crystal display according to an exemplary embodiment of the present invention.

FIG. 1 is a block diagram illustrating a liquid crystal display according to an exemplary embodiment of the present invention. FIG. 2 is a block diagram illustrating a data driver of a liquid crystal display according to an exemplary embodiment of the present invention.

Referring to FIGS. 1 and 2, the liquid crystal display includes a liquid crystal panel 300, a gate driver 400, a data driver 500, and a signal controller 600.

The liquid crystal panel 300 includes a plurality of pixels PX which is arranged substantially in a matrix. The plurality of pixels PX is connected to a plurality of signal lines. The signal lines include a plurality of gate lines G1, G2, . . . which transmits a gate signal (also referred to as a "scanning signal") and data lines D1, D2, . . . which transmit a data voltage. The plurality of gate lines G1, G2, . . . extends in a row direction to be substantially parallel to each other. The plurality of data lines D1, D2, . . . extends in a column direction to be substantially parallel to each other.

The pixels PX which are adjacent to each other in the column direction are connected to different data lines and the pixels PX which are adjacent to each other in the row direction are connected to the data lines which are located at the same side of the pixels PX. In other words, according to the exemplary embodiment of FIG. 1, the pixels PX which are disposed in one column are alternately connected to different data lines among data lines which are disposed at left and right sides of the pixels PX. Additionally, the pixels PX which are disposed in one row are connected to the data lines which are disposed at the same side of the pixels PX, among the data lines which are disposed at left and right sides of the pixels PX. In the exemplary embodiment of FIG. 1, all of the pixels PX disposed in a first row are connected to data lines disposed at a left side of the pixels PX in the first row.

The liquid crystal panel 300 which includes the pixels PX connected as illustrated in FIG. 1 may configure apparent inversion such as dot inversion even when data voltages having the same polarity are applied to one data line for one frame. The power which is consumed in the liquid crystal panel 300 may be reduced by the pixel connection structure.

The gate driver 400 is connected to the plurality of gate lines G1, G2, . . . of the liquid crystal panel 300 to apply a gate signal configured by combining a gate-on voltage Von and a gate-off voltage Voff to the gate lines G1, G2, . . . . When the gate-on voltage Von is applied, a switching element, such as a thin film transistor, which is located in a corresponding pixel PX is turned on.

The data driver 500 is connected to the plurality of data lines D1, D2, . . . of the liquid crystal panel 300 and changes data which is a digital signal into a data voltage which is an analog voltage to apply the changed data to the plurality of data lines D1, D2, . . . . To change the data into the data voltage, the liquid crystal panel may further include a gray voltage generator and the gray voltage generator may be formed in the data driver 500 or outside the data driver 500. The data driver 500 selects a voltage corresponding to the data among voltages generated in the gray voltage generator and converts the selected voltage into a data voltage. The gray voltage generator generates two sets of gray voltages to perform inversion driving. One of two sets has a positive value with respect to a common voltage Vcom and the other set has a negative value.

The data driver 500 according to an exemplary embodiment of the present invention includes a DAC unit 540, an amplifier 550, a MUX unit 560, a plurality of switches for sharing a charge, and a plurality of capacitors Cp1, Cp2, Cp3, Cn1, Cn2, and Cn3. Charge sharing of according to an exemplary embodiment of the present invention may be classified into two types. There are first charge sharing (hereinafter, also referred to as "CS1") which shorts a data line having a positive voltage from a data line having a negative voltage to share a charge and second charge sharing (hereinafter, also referred to as "CS2") which shorts data lines having the same polarity from each other to share a charge. Referring to FIG. 2, the data driver 500 includes a switch S1 for first charge sharing, switches SW1, SW2, and SW3 for second charge sharing, and a switch S0 which disconnects a data voltage applying source and a data line from each other. The switch S0 which disconnects a data voltage applying source and a data line from each other is closer to the data voltage applying source than the switch S1 for sharing a first charge. When the first charge is shared, the data voltage applying source is separated and adjacent data lines are connected to each other. The switch S1 for sharing a first charge is closed by a CS1 signal and in this case, the switch S0 which disconnects the data voltage applying source from the data line is open. Further, there are two types of switches SW1, SW2, and SW3 for sharing a second charge due to different polarities and each switch is by a SW_PO (SW_PE) or SW_NO (SW_NE) signal. In this case, the switch S0 which disconnects the data voltage applying source from the data line may be closed.

The first charge sharing CS1 shorts two adjacent data lines to which the positive voltage and the negative voltage are applied so that the two data lines have an intermediate voltage. The intermediate voltage is a voltage corresponding to a common voltage Vcom and has a value which varies in accordance with a charge which is applied to the wiring line. According to the charge sharing method, a voltage reaches the intermediate voltage without needing separate driving so that the corresponding line reaches an opposite polarity in a next frame. In this case, the power is not separately consumed.

In addition, the second charge sharing CS2 shorts the plurality of data lines to which a data voltage having the same polarity is applied. Here, the two adjacent data lines may be shorted from each other or all of the data lines to which the voltage having the same polarity is applied may be shorted. In the exemplary embodiment of FIG. 2, among all of the data lines, all of the data lines to which a positive data voltage is applied are shorted and all of the data lines to which a negative data voltage is applied are shorted. In other words, all of the data lines to which a positive data voltage is applied by a SW_PO signal are shorted and all of the data lines to which a negative data voltage is applied by the SW_NE signal are shorted. In this case, the SW_NO signal and the SW_PE signal are applied as off-signals which open the switches SW1, SW2, and SW3. In a next frame when the data voltage which is applied to the data lines is inverted, all of the data lines to which the positive data voltage is applied by the SW_PE signal are shorted and all of the data lines to which the negative data voltage is applied by the SW_NO signal are shorted. In this case, the SW_PO signal and the SW_NE signal are applied as off-signals which open the switches SW1, SW2, and SW3. In one frame, the SW_PO signal and the SW_NE signal may selectively and step-wisely close the switches SW1, SW2, and SW3 for the second charge sharing. In the subsequent frame, the SW_PE signal and the SW_NO signal may selectively and step-wisely close the switches SW1, SW2, and SW3 for the second charge sharing. When all of the data lines to which the same data voltage is applied are shorted at the time of the second charge sharing CS2, the data lines are shorted from the data voltage applying source which applies a voltage to the data lines so that the data lines having the same polarity share the charge to step-wisely vary the voltage of the data lines at the same polarity.

The plurality of data lines D1, D2, . . . may have self-capacitances. When the SW_PO signal and the SW_NE signal, or the SW_PE signal and the SW_NO signal are applied, capacitors of the individual data lines are coupled in parallel to the capacitors Cp1, Cp2, Cp3, Cn1, Cn2, and Cn3 which are connected thereto.

In other words, when data lines to which the positive data voltage is applied are connected by the SW_PO signal or the SW_PE signal, the capacitances of the individual data lines are selectively connected to the first to third positive voltage capacitors Cp1, Cp2, and Cp3 to share the charge. A voltage of the data line which is connected to the first positive voltage capacitor Cp1 when the first switch SW1 is closed by the SW_PO signal or the SW_PE signal and one end of the first positive voltage capacitor Cp1 is Vcp1. A voltage of the data line which is connected to the second positive voltage capacitor Cp2 when the second switch SW2 is closed by the SW_PO signal or the SW_PE signal and one end of the second positive voltage capacitor Cp2 is Vcp2. A voltage of the data line which is connected to the third positive voltage capacitor Cp3 when the third switch SW3 is closed by the SW_PO signal or the SW_PE signal and one end of the third positive voltage capacitor Cp3 is Vcp3. The voltage Vcp2 is larger than the voltage Vcp1 and the voltage Vcp3 is larger than the voltage Vcp2. In other words, the first to third positive voltage capacitors Cp1, Cp2, and Cp3 may have different voltages and the voltages may be step-wisely increased. In this case, the voltage Vcp1, the voltage Vcp2, and the voltage Vcp3 vary in accordance with the connected capacitances and have a positive value, but when capacitances of the first to third positive voltage capacitors Cp1, Cp2, and Cp3 are larger than the capacitance of the data line, the voltage Vcp1, the voltage Vcp2, and the voltage Vcp3 may have a substantially constant positive value. The switches SW1, SW2, and SW3 which connect the data lines to the first to third positive voltage capacitors Cp1, Cp2, and Cp3 may be called positive voltage switches.

Additionally, when the data lines to which the negative data voltage is applied are connected by the SW_NO signal or the SW_NE signal, the capacitances of the individual data lines are selectively connected to the first to third negative voltage capacitors Cn1, Cn2, and Cn3 to share the charge. The first switch SW1 is closed by the SW_NO signal or the SW_NE signal, so that the voltage of the data line, which is connected to the first negative voltage capacitor Cn1 and one end of the first negative voltage capacitor Cn1, is Vcn1. The second switch SW2 is closed by the SW_NO signal or the SW_NE signal so that the voltage of the data line, which is connected to the second negative voltage capacitor Cn2 and one end of the second negative voltage capacitor Cn2, is Vcn2. The third switch SW3 is closed by the SW_NO signal or the SW_NE signal so that the voltage of the data line, which is connected to the third negative voltage capacitor Cn3 and one end of the third negative voltage capacitor Cn3, is Vcn3. The voltage Vcn2 is smaller than the voltage Vcn1 and the voltage Vcn3 is smaller than the voltage Vcn2. In other words, the first to third negative voltage capacitors Cn1, Cn2, and Cn3 have different voltages and the voltages may be step-wisely lowered. In this case, the voltage Vcn1, the voltage Vcn2, and the voltage Vcn3 vary in accordance with the connected capacitances and have a negative value, but when the capacitances of the first to third negative voltage capacitors Cn1, Cn2, Cn3 are larger than the capacitance of the data line, the voltage Vcn1, the voltage Vcn2, and the voltage Vcn3 may have a substantially constant negative value. The switches SW1, SW2, and SW3 which connect the data lines to the first to third negative voltage capacitors Cn1, Cn2, and Cn3 may called negative voltage switches. FIG. 2 illustrates that a positive voltage switch and a negative voltage switch are disposed in all of the plurality of data lines D1, D2, . . . .

In FIG. 2, even though the first to third positive voltage capacitors Cp1, Cp2, and Cp3 and the first to third negative voltage capacitors Cn1, Cn2, and Cn3 are included in the data driver 500, in an exemplary embodiment of the present invention, the capacitors Cp1 Cp2, Cp3, Cn1, Cn2 and Cn3 may be disposed at the outside of the data driver 500.

The DAC unit 540 converts an image signal DAT which is digital data into a data voltage which is an analog value. In other words, the DAC unit 540 is a digital-to-analog converter. In this case, the DAC unit 540 may select and convert one of gray voltages in the gray voltage generator. The DAC unit 540 includes a positive DAC unit (P-DAC) which converts an image signal DAT into a positive data voltage and a negative DAC unit (N-DAC) which converts an image signal into a negative data voltage.

The amplifier 550 amplifies a data voltage using a bias current Ibias. An amplifier 550 which is connected to a positive DAC unit P-DAC outputs a positive data voltage and an amplifier 550 which is connected to a negative DAC unit N-DAC outputs a negative data voltage. In other words, the amplifier 550 serves as a buffer which generates a data voltage.

The MUX unit 560 selects a data voltage in accordance with a polarity by an inversion signal POL to adjust the data voltage to be applied to a data line. The MUX unit 560 may be a multiplexer.

When one frame passes, a polarity of the inversion signal POL is changed and thus a polarity of the data voltage which is applied to each data line is changed. This way, the MUX unit 560 changes a path through which the data voltage is applied.

Additionally, the CS1 signal for first charge sharing, and the SW_PO signal, the SW_PE signal, the SW_NO signal, and the SW_NE signal for second charge sharing may be provided from the signal controller 600 but not altogether.

The signal controller 600 controls the gate driver 400 and the data driver 500.

The signal controller 600 receives input image signals R, G, and B and an input control signal which controls the input image signals to be displayed, from an external graphic controller. The input image signals R, G and B load luminance information of the pixels PX and the luminance information has a predetermined number of gray scales, for example, $1024=2^{10}$, $256=2^{8}$ or $64=2^{6}$ gray scales. Examples of the input control signal include a vertical synchronization signal Vsync, a horizontal synchronization signal Hsync, a main clock MCLK, and a data enable signal DE.

The signal controller 600 appropriately processes the input image signals R, G and B based on the input image signals R, G and B and the input control signal in accordance with an operating condition of the liquid crystal panel 300 and the data driver 500. The signal controller 600 generates a gate control signal CONT1, a data control signal CONT2, and backlight control signal and then outputs the gate control signal CONT1 to the gate driver 400 and outputs the data control signal CONT2 and the processed image signal DAT to the data driver 500. The backlight control signal is output to a backlight unit. The image signal DAT is a digital signal and has a predetermined number of values (or gray scales).

The gate control signal CONT1 includes a scanning start signal STV which instructs scanning to start and a pair of clock signals which controls an output period of the gate-on voltage Von. The gate control signal CONT1 may further include an output enable signal OE which limits a time duration of the gate-on voltage Von.

The data control signal CONT2 includes a horizontal synchronization start signal STH which instructs the image data to start being transmitted to one row of pixels PX, a load signal TP to apply the data signal to the data lines D1, D2, . . . , and a data clock signal HCLK. The data control signal CONT2 may further include an inversion signal POL (hereinafter, also referred to as a "POL signal") which inverts a voltage polarity of the data signal with respect to the common voltage Vcom. Hereinafter voltage polarity of the data signal with respect to the common voltage Vcom is also referred to as a "polarity of a data signal."

In accordance with the data control signal CONT2 from the signal controller 600, the data driver 500 receives a digital image signal DAT for one row of pixels PX and selects gray voltages corresponding to the digital image signal DAT to convert the digital image signal DAT into an analog data signal and then applies the converted signal to the corresponding data lines D1, D2, . . . . The number of gray voltages which is generated by the gray voltage generator may be equal to the number of gray scales represented by the digital image signal DAT.

Individual driving devices 400, 500, and 600 may be directly mounted on the liquid crystal panel 300 in the form of at least one integrate circuit (IC) chip or mounted on a flexible printed circuit film to be attached onto the liquid crystal panel 300 in the form of a tape carrier package (TCP). Additionally, the driving devices 400, 500, and 600 may be integrated into the liquid crystal panel 300 together with the signal lines and the thin film transistor switching elements. Further, all of the driving devices 400, 500, and 600 may be integrated as one single chip and in this case, at least one of the driving devices or at least one of the circuit elements which configure the driving device may be located at the outside of the single chip.

A subsequent frame starts as soon as one frame ends and a state of the inversion signal (POL) which is applied to the data driver 500 is controlled such that a polarity of the data signal which is applied to the pixel PX is opposite to a polarity of a previous frame. In other words, "frame inversion". In this case, a polarity of a voltage which is applied to one data line during one frame is not changed so that the data voltage is applied to the data line in the same manner as in column inversion, but the apparent inversion is the same as dot inversion due to a pixel connection structure of the liquid crystal display of FIGS. 1 and 2.

The liquid crystal display according to an exemplary embodiment of the present invention changes a polarity of the data voltage which is applied to the data lines D1, D2, . . . for each frame. Therefore, a half of the period of the inversion signal POL is one frame.

In one frame, 1H. which is a time when one gate-on voltage Von is applied by the horizontal synchronization start signal STH. is divided. During the time of 1H, the gate-on voltage Von is applied to one row of gate lines G1, G2, . . . and the data voltage is applied to the pixels of the row.

When the inversion signal POL is inverted, the CS1 signal is converted into an ON voltage during an inverted 1H section. As a result, the switch S1 for first charge sharing is closed and the first charge sharing is established. Data lines having a positive voltage and a negative voltage are shorted from each other by the first charge sharing. In this case, the switch S0 which disconnects the data voltage applying source from the data line is open. In an exemplary embodiment of the present invention, two adjacent data lines may be shorted or all of the data lines may be shorted. The inversion signal POL is inverted for each frame so that 1H when the CS1 signal is applied may be a first 1H for one frame. At the first 1H, the second charge sharing is not performed. In the second charge sharing, positive voltages or negative voltages share charges, so that the second charge sharing is different from the first charge sharing which shares the positive voltage and the negative voltage. Thus, the second charge sharing and the first charge sharing are separately performed.

Hereinafter, a method of performing the second charge sharing will be illustrated by way of a waveform diagram with reference to FIG. 3.

Figure 3:
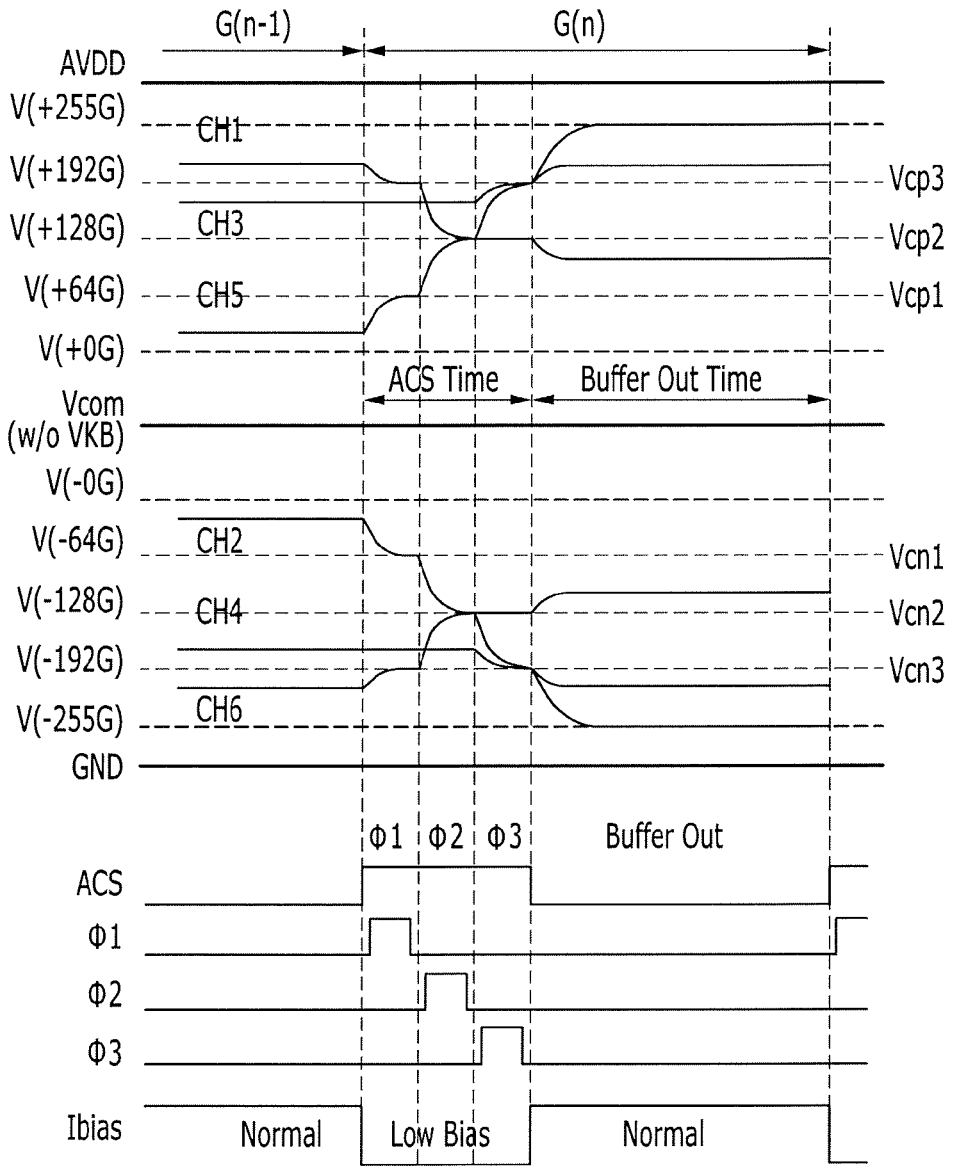
FIG. 3 is a waveform diagram illustrating a driving method of a liquid crystal display according to an exemplary embodiment of the present invention.

FIG. 3 is a waveform diagram illustrating a driving method of a liquid crystal display according to an exemplary embodiment of the present invention.

Referring to FIG. 3, the second charge sharing is selectively performed only when a predetermined condition is satisfied during the 1H period excluding the first 1H in one frame. In other words, the first charge sharing and the second charge sharing are performed during different 1H periods so that the first charge sharing and the second charge sharing do not overlap.

In the second charge sharing, the power consumption is large when charge moves between a high gray scale of a data voltage and a low gray scale of a data voltage in the data lines having the same polarity. This way, after moving to a voltage close to a target data voltage through the second charge sharing and then moving the voltage to the target data voltage, a variation width of a voltage moved by the data driver 500 is reduced.

Voltages which are applied to the data lines vary for each image to be displayed so that when the second charge sharing is actually performed, the variation width of the voltage moved by the data driver 500 may be increased. Therefore, the second charge sharing is selectively performed.

The signal controller 600 or the data driver 500 may determine whether to perform the second charge sharing and there are various determining methods. For example, to determine whether to perform the second charge sharing, it is determined whether a data voltage which is applied to a data line during a period when a gate signal Gn of the present row is applied is different from a data voltage which is applied to the data line during a period when a gate signal Gn-1 of a previous row is applied. It is also determined whether the voltage variation passes through low gray voltages Vcp1 and Vcn1, middle gray voltages Vcp2 and Vcn2, and high gray voltages Vcp3 and Vcn3. In other words, if there is a variation between the data voltages and the voltage variation passes through at least one of the low gray voltages Vcp1 and Vcn1, the middle gray voltages Vcp2 and Vcn2, and the high gray voltages Vcp3 and Vcn3, the second charge sharing is performed by using the corresponding gray voltage and the data voltage moves to the target data voltage. This way, power consumption may be reduced.

In FIG. 3, a positive zero gray voltage V (+0 G) to a positive 255 gray voltage V (+255G) are illustrated as a positive data voltage and a negative zero gray voltage V (−0G) to a negative 255 gray voltage V (−255G) are illustrated as a negative data voltage. In this case, a positive low gray voltage Vcp1 which becomes a reference to determine whether to perform the second charge sharing is a positive 64 gray voltage V (+64G) and a positive middle gray voltage Vcp2 is a positive 128 gray voltage V (+128G), and a positive high gray voltage Vcp3 is a positive 192 gray voltage V (+192G). Further, a negative low gray voltage Vcn1 is a negative 64 gray voltage V (−64G), a negative middle gray voltage Vcn2 is a negative 128 gray voltage V (−128G), and a negative high gray voltage Vcn3 is a negative 192 gray voltage V (−192G). These values are merely exemplary. For example, the values of the gray voltages which become a reference to determine whether to perform the second charge sharing may be various. Further, the ranges of the positive gray voltages as the positive data voltage and the ranges of the negative gray voltages as the negative data voltage may be various and not limited to the aforementioned ranges.

A period (corresponding to 1H) when the present row of a gate signal G(n) is applied includes an ACS time when the second charge sharing is performed and a buffer output time when the data voltage is output. The ACS time corresponds to a time when an ACS signal is applied as an enable voltage (e.g., a high level voltage). The ACS signal is a signal which instructs the second charge sharing to be performed. The ACS time is divided into three sections to step-wisely perform the second charge sharing. A first section is a section when a first phase signal Φ1 is applied by an on-voltage, a second section is a section when a second phase signal Φ2 is applied by an on-voltage, and a third section is a section when a third phase signal Φ3 is applied by an on-voltage.

During the first section, the first switch SW1 for the second charge sharing is closed. In this case, a voltage of the data line which is lower than the positive low gray voltage Vcp1 moves to the positive low gray voltage Vcp1 (see CH5) or a voltage of the data line which is higher than the positive high gray voltage Vcp3 moves to the positive high gray voltage Vcp3 (see CH1). Further, a voltage of the data line which is higher than the negative low gray voltage Vcn1 moves to the negative low gray voltage Vcn1 (see CH2) or a voltage of the data line which is lower than the negative high gray voltage Vcn3 moves to the negative high gray voltage Vcn3 (see CH6).

During the second section, the second switch SW2 for the second charge sharing is closed. In this case, a voltage of the data line which is lower than the positive middle gray voltage Vcp2 moves to the positive middle gray voltage Vcp2 (see CH5) or a voltage of the data line which is higher than the positive middle gray voltage Vcp2 moves to the positive middle gray voltage Vcp2 (see CH1). Further, a voltage of the data line which is higher than the negative middle gray voltage Vcn2 moves to the negative middle gray voltage Vcn2 (see CH2) or a voltage of the data line which is lower than the negative middle gray voltage Vcn2 moves to the negative middle gray voltage Vcn2 (see CH6).

During the third section, the third switch SW3 for the second charge sharing is closed. In this case, a voltage of the data line which is lower than the positive high gray voltage Vcp3 moves to the positive high gray voltage Vcp3 (refer to CH5 and CH3). Further, a voltage of the data line which is higher than the negative high gray voltage Vcn3 moves to the negative high gray voltage Vcn3 (see CH2 and CH4).

Additionally, the bias current (Ibias) which is provided to the amplifier 550 may be minimized during the ACS time and thus the power consumption of the data driver 500 may be lowered.

Next, during a buffer output time, the ACS signal is applied as a disable signal (e.g., a low level voltage). When the ACS signal is applied as the disable signal, an ACSb signal (see FIG. 2) which is a reverse signal of the ACS signal is applied as an enable signal. This way, the switch S0 which disconnects the data voltage applying source and the data line from each other is closed (see FIG. 2), the data voltage is output to the data line, and the voltage of the data line moves to the target data voltage.

As described above, the second charge sharing is stepwisely performed by a voltage which is close to the target data voltage and then finally moves to the target data voltage. Since the data driver 500 moves a voltage by a variation width of the voltage which moves during the buffer output time, the power consumption of the liquid crystal display may be reduced.

Hereinafter, a configuration of a data driver 500 for performing the second charge sharing described above will be described.

Figure 4:
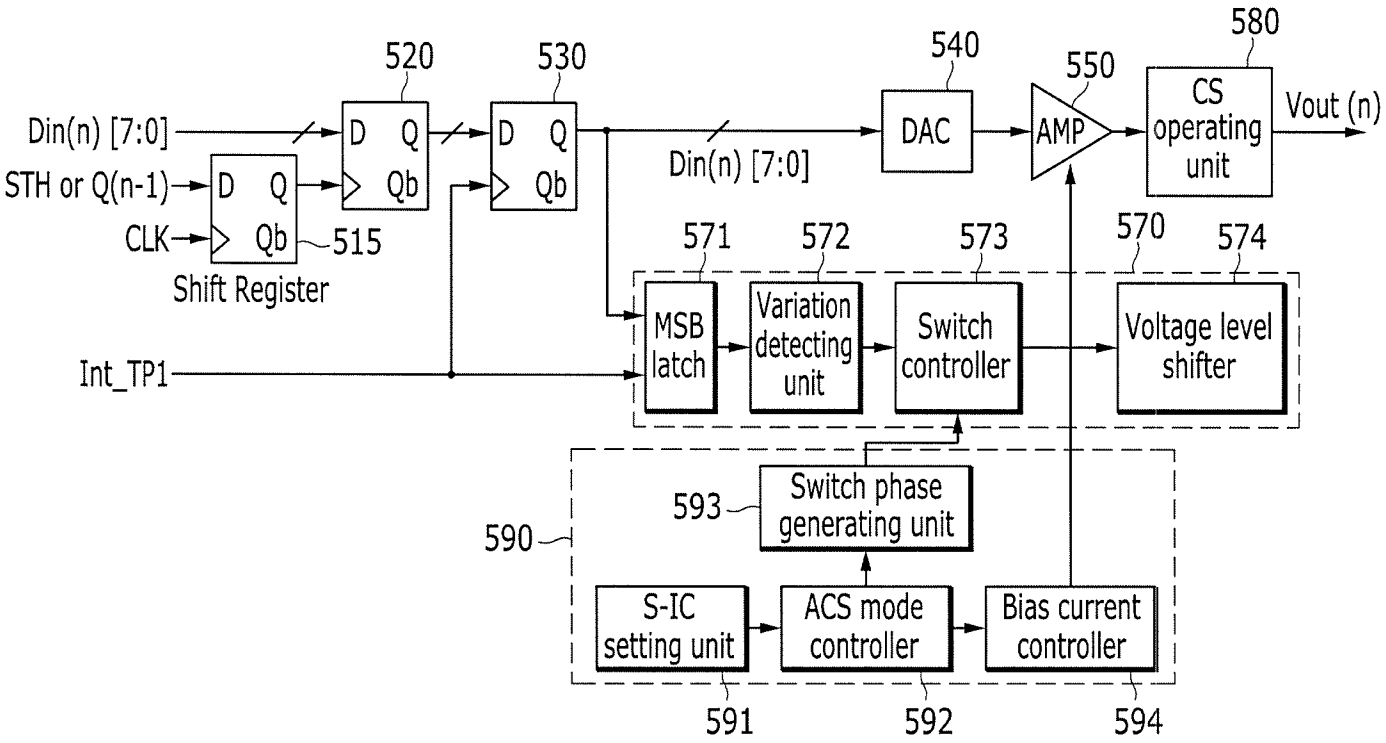
FIG. 4 is a block diagram illustrating a data driver of a liquid crystal display according to an exemplary embodiment of the present invention.

FIG. 4 is a block diagram of a data driver of a liquid crystal display according to an exemplary embodiment of the present invention.

Referring to FIG. 4, the data driver 500 includes a shift register 515, a first latch 520, a second latch 530, a DAC unit 540, an amplifier 550, a charge sharing controller 570, a charge sharing operating unit 580, and a driving controller 590.

The data driver 500 may include a plurality of sources ICs (S-ICs).

When the image data Din(n) is input, the shift register 515 stores only image data required for the corresponding source IC and transmits next image data to a next source IC.

The first latch 520 samples and stores the image data and samples only image data corresponding to the data line which is controlled by the corresponding source IC. The second latch 530 receives and stores the image data which is sampled by the first latch 520. In an exemplary embodiment of the present invention, the data driver 500 may include only one latch. The second latch 530 transmits the image data to the DAC unit 540 and the charge sharing controller 570.

The DAC unit 540 converts the image data which is a digital signal stored by the second latch 520 into an analog data voltage. In this case, the DAC unit 540 may select one of gray voltages in the gray voltage generator to convert the selected gray voltage.

The amplifier 550 amplifies and outputs the data voltage.

The charge sharing operating unit 580 includes the switch S1 for first charge sharing and the switches SW1, SW2, and SW3 for second charge sharing and operates in accordance with the switch control signal applied from the charge sharing controller 570.

The charge sharing controller 570 receives the image data output from the second latch 530 and the TP1 signal (Int_TP1) to generate a signal to control the charge sharing operating unit 580. The TP1 signal may be a load signal for the corresponding source IC.

The driving controller 590 generates a synchronization signal used to perform second charge sharing. The driving controller 590 includes an S-IC setting unit 591, an ACS mode controller 592, a switch phase generating unit 593, and a bias current controller 594.

The S-IC setting unit 591 stores setting information of the source IC such as an output data voltage range of the corresponding source IC.

The ACS mode controller 592 generates an ACS signal to indicate an ACS time for performing the second charge sharing.

The switch phase generating unit 593 generates first to third phase signals Φ1, Φ2, and Φ3 which indicate the first to third section included in the ACS time. The switch phase generating unit 593 provides the ACS signal to the charge sharing controller 570 together with first to third phase signals Φ1, Φ2, and Φ3.

The bias current controller 594 reduces the bias current Ibias which is applied to the amplifier 550 at the ACS time in accordance with the ACS signal to a minimum.

The charge sharing controller 570 includes an MSB latch 571, a variation detecting unit 572, a switch controller 573, and a voltage level shifter 574.

The MSB latch 571 receives the image data output from the second latch 530 and the TP1 signal to store the image data. The MSB latch 571 may store 2 bits of a most significant bit (MSB) of the image data (hereinafter, also referred to as "MSB 2 bit"). The MSB latch 571 transmits MSB 2 bit of an image data corresponding to a gate signal of a previous row and MSB 2 bit of an image data corresponding to a gate signal of a present row to the variation detecting unit 572.

The variation detecting unit 572 compares the MSB 2 bit of the image data corresponding to the gate signal of the previous row with the MSB 2 bit of the image data corresponding to the gate signal of the present row to detect a variation of individual voltages of the plurality of data lines.

The switch controller 573 generates a switch control signal to open and close the switches SW1, SW2, and SW3 for second charge sharing in accordance with the type of voltage variation detected.

The voltage level shifter 574 shifts a voltage level of the switch control signal to transmit the switch control signal to the charge sharing operating unit 580.

Figure 5:
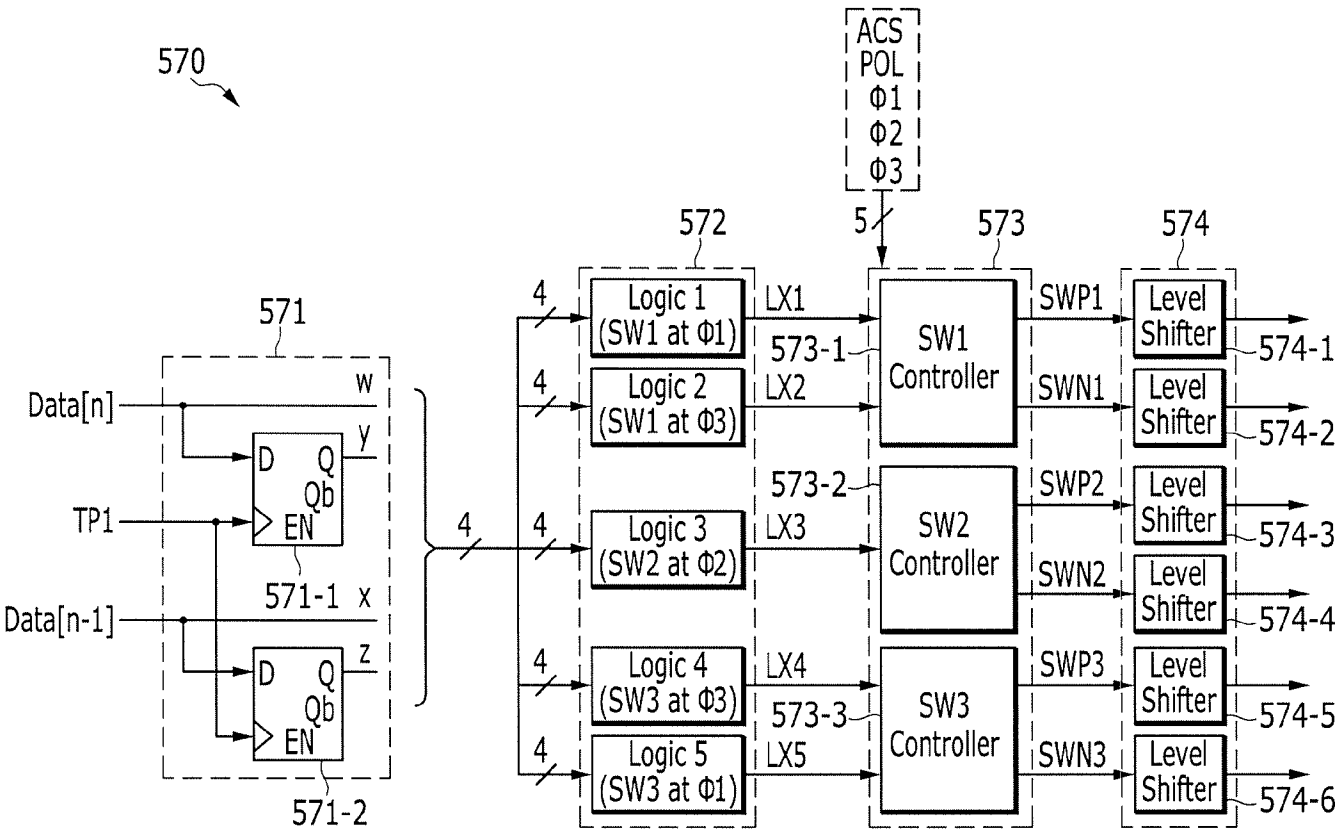
FIG. 5 is a block diagram illustrating a charge sharing controller of FIG. 4, according to an exemplary embodiment of the present invention.
Figure 7:
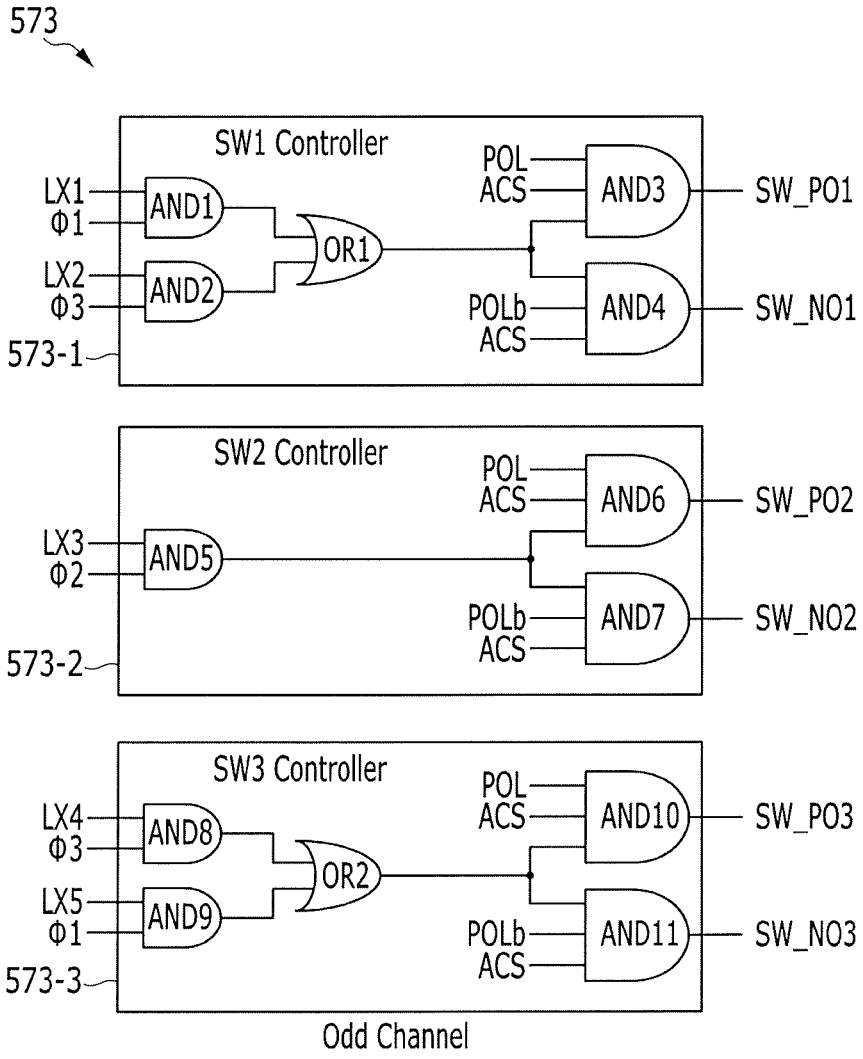
FIGS. 7 and 8 are block diagrams illustrating a switch controller of FIG. 5, according to an exemplary embodiment of the present invention.
Figure 8:
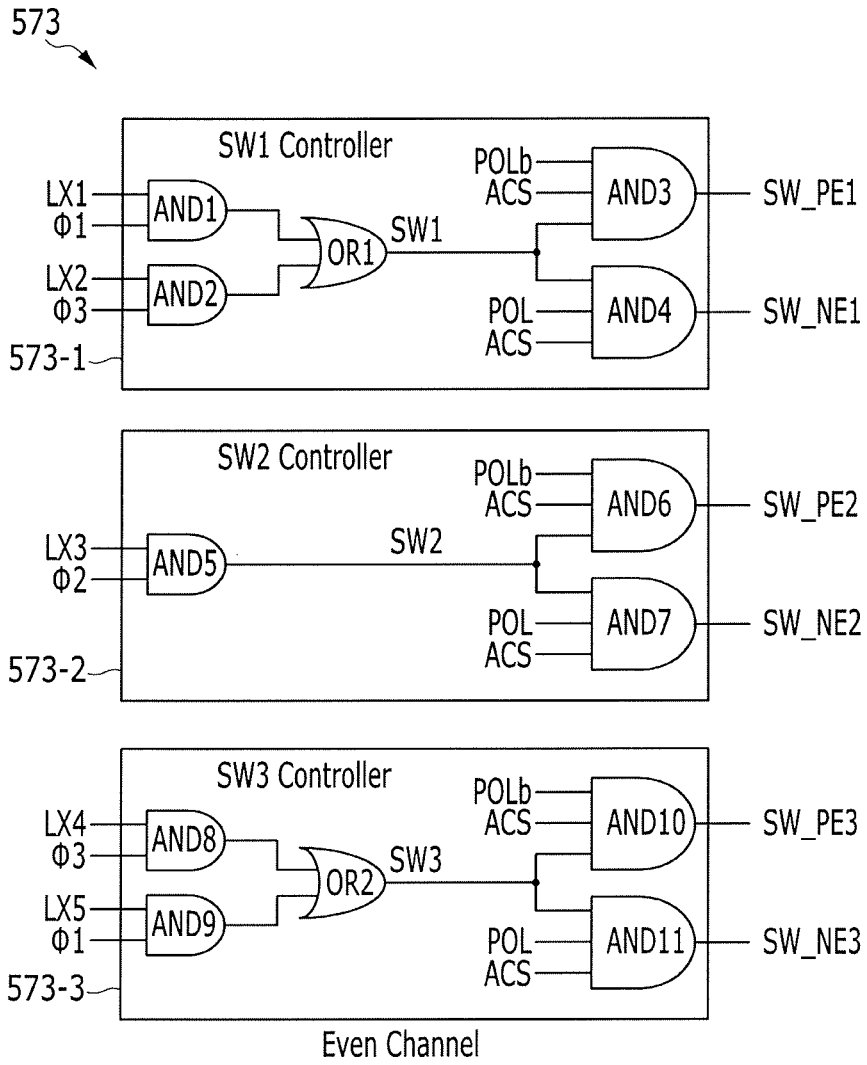

FIG. 5 is a block diagram illustrating the charge sharing controller of FIG. 4 in more detail, according to an exemplary embodiment of the present invention. FIG. 6 is a table illustrating an output value of a logic circuit included in a variation detecting unit of FIG. 5, according to an exemplary embodiment of the present invention. FIGS. 7 and 8 are block diagrams illustrating a switch controller of FIG. 5 in more detail, according to an exemplary embodiment of the present invention.

Referring to FIGS. 5 to 8, the MSB latch 571 includes a first MSB latch 571-1 and a second MSB latch 571-2. The first MSB latch 571-1 stores MSB first bit value Data[n] of the image data (when the data is n bits). The second MSB latch 571-2 stores MSB second bit value Data[n−1] of the image data.

The MSB latch 571 receives the image data corresponding to the gate signal of the present row together with the TP1 signal to output MSB first bit value (w) and MSB second bit value (x). In this case, the first MSB latch 571-1 outputs MSB first bit value (y) of the image data corresponding to the gate signal of the previous row which is stored in response to the TP1 signal and the second MSB latch 571-2 outputs MSB second bit value (z) of the image data corresponding to the gate signal of the previous row which is stored in response to the TP1 signal.

The variation detecting unit 572 includes first to fifth logic circuits Logic1, Logic2, Logic3, Logic4, and Logic5. The first to fifth logic circuits Logic1, Logic2, Logic3, Logic4, and Logic5 detect a type of voltage variation in accordance with the second charge sharing, from the bit values w, x, y, and z output from the MSB latch 571. The first logic circuit Logic1 outputs a first logic value LX1 which controls the first switch SW1 for second charge sharing in synchronization with the first phase signal Φ1. The second logic circuit Logic2 outputs a second logic value LX2 which controls the first switch SW1 for second charge sharing in synchronization with the third phase signal Φ3. The third logic circuit Logic3 outputs a third logic value LX3 to control the second switch SW2 for second charge sharing in synchronization with the second phase signal Φ2. The fourth logic circuit Logic4 outputs a fourth logic value LX4 which controls the third switch SW3 for second charge sharing in synchronization with the third phase signal Φ3. The fifth logic circuit Logic5 outputs a fifth logic value LX5 which controls the third switch SW3 for second charge sharing in synchronization with the first phase signal Φ1.

The first to fifth logic circuits Logic1, Logic2, Logic3, Logic4, and Logic5 may generate the first to fifth logic values LX1, LX2, LX3, LX4, and LX5 in accordance with Equation 1.

$$LX1=w\overline{yz}+\overline{wx}yz+\overline{wxyz}$$

$$LX2=\overline{wx}y$$

$$LX3=w\overline{y}+\overline{w}y$$

$$LX4=wx\overline{y}$$

$$LX5=\overline{wy}z+wxy\overline{z}+w\overline{x}y\overline{z} \quad \text{(Equation 1)}$$

FIG. 6 illustrates first to fifth logic values LX1, LX2, LX3, LX4, and LX5 output from the first to fifth logic circuits Logic1, Logic2, Logic3, Logic4, and Logic5 in accordance with the MSB 2 bit value yz of the image data corresponding to the gate signal of the previous row and the MSB 2 bit value wx of the image data corresponding to the gate signal of the present row.

The switch controller 573 includes a first switch controller 573-1, a second switch controller 573-2 and a third switch controller 573-3. The first switch controller 573-1 receives the first logic value LX1 and the second logic value LX2 and generates control signals SWP1 and SWN1 of the first switch SW1. The second switch controller 573-2 receives the third logic value LX3 and generates control signals SWP2 and SWN2 of the second switch SW2. The third switch controller 573-3 receives the fourth logic value LX4 and the fifth logic value LX5 and generates control signals SWP3 and SWN3 of the third switch SW3.

As illustrated in FIG. 2, the control signal which controls the switches SW1, SW2, and SW3 for second charge sharing includes control signals SW_PO and SW_NO to control the switches of odd numbered data lines (e.g., an odd numbered channel) and control signals SW_PE and SW_NE to control the switch of even numbered data lines (e.g., an even numbered channel). As further illustrated in FIG. 2, the control signals SW_PO and SW_NO of the odd channel and the control signals SW_PE and SW_NE of the even channel are applied as different signals.

For this operation, the first switch controller 573-1, the second switch controller 573-2, and the third switch controller 573-3 are provided in the odd channel and the even channel.

FIG. 7 illustrates the first switch controller 573-1, the second switch controller 573-2, and the third switch controller 573-3 of the odd channel and FIG. 8 illustrates the first switch controller 573-1, the second switch controller 573-2, and the third switch controller 573-3 of the even channel. In FIGS. 7 and 8, the switch controllers 573 have the same structure except that inputs of the POL signal and the POLb signal are different. The POLb signal is a reversed signal of the POL signal.

First, referring to FIG. 7, the first switch controller 573-1 includes a first AND unit AND1, a second AND unit AND2, a first OR unit OR1, a third AND unit AND3, and a fourth AND unit AND4.

The first AND unit AND1 receives the first logic value LX1 and a first phase signal Φ1 and outputs 1 when both values are 1 and otherwise, the first AND unit AND1 outputs 0.

The second AND unit AND2 receives the second logic value LX2 and the third phase signal Φ3 and outputs 1 when both values are 1 and otherwise, the second AND unit AND2 outputs 0.

The first OR unit OR1 compares output values of the first AND unit AND1 and the second AND unit AND2 and when at least one of the output values is 1, the first OR unit OR1 outputs 1 and when both values are 0, the first OR unit OR1 outputs 0.

The third AND unit AND3 receives the output value of the first OR unit OR1, the ACS signal, and the POL signal and when all three values are 1, the third AND unit AND3 outputs 1 and otherwise, the third AND unit AND3 outputs 0. The output value of the third AND unit AND3 is a switch control signal SW_PO1 which controls the first switch SW1 which connects the data line of the odd channel to the first positive voltage capacitor Cp1. When the output value of the third AND unit AND3 is 1, the first switch SW1 is closed.

The fourth AND unit AND4 receives an output value of the first OR unit OR1, the ACS signal, and the POLb signal and when all three values are 1, the fourth AND unit AND4 outputs 1 and otherwise, the fourth AND unit AND4 outputs 0. The output value of the fourth AND unit AND4 is a switch control signal SW_NO1 which controls the first switch SW1 which connects the data line of the odd channel to the first negative voltage capacitor Cn1. When the output value of the fourth AND unit AND4 is 1, the first switch SW1 is closed.

The output values of the third AND unit AND3 and the fourth AND unit AND4 are determined by the POL signal and the POLb signal so that the third AND unit AND3 and the fourth AND unit AND4 do not simultaneously output 1.

The second switch controller 573-2 includes a fifth AND unit AND5, a sixth AND unit AND6, and a seventh AND unit AND7.

The fifth AND unit AND5 receives the third logic value LX3 and the second phase signal Φ2 and when both values are 1, the fifth AND unit AND5 output 1 and otherwise, the fifth AND unit AND5 outputs 0.

The sixth AND unit AND6 receives the output value of the fifth AND unit AND5, the ACS signal, and the POL signal and when all three values are 1, the sixth AND unit AND6 outputs 1 and otherwise, the sixth AND unit AND6 outputs 0. The output value of the sixth AND unit AND6 is a switch control signal SW_PO2 which controls the second switch SW2 which connects the data line of the odd channel to the second positive voltage capacitor Cp2. When the output value of the sixth AND unit AND6 is 1, the second switch SW2 is closed.

The seventh AND unit AND7 receives the output value of the fifth AND unit AND5, the ACS signal, and the POLb signal and when all three values are 1, the seventh AND unit AND7 outputs 1 and otherwise, the seventh AND unit AND7 outputs 0. The output value of the seventh AND unit AND7 is a switch control signal SW_NO2 which controls the switch SW1 which connects the data line of the odd channel to the first negative voltage capacitor Cn1. When the output value of the fourth AND unit AND4 is 1, the switch SW1 is closed.

The output values of the sixth AND unit AND6 and the seventh AND unit AND7 are determined by the POL signal and the POLb signal so that the sixth AND unit AND6 and the seventh AND unit AND7 do not simultaneously output 1.

The third switch controller 573-3 includes an eighth AND unit AND8, a ninth AND unit AND9, a second OR unit OR2, a tenth AND unit AND10, and an eleventh AND unit AND11.

The eighth AND unit AND8 receives the fourth logic value LX4 and the third phase signal Φ3 and when both values are 1, the eighth AND unit AND8 outputs 1 and otherwise, the eighth AND unit AND8 outputs 0.

The ninth AND unit AND9 receives the fifth logic value LX5 and the first phase signal Φ1 and when both values are 1, the ninth AND unit AND9 outputs 1 and otherwise, the ninth AND unit AND9 outputs 0.

The second OR unit OR2 compares output values of the eighth AND unit AND8 and the ninth AND unit AND9 and when at least one of the output values is 1, the second OR unit OR2 outputs 1 and when both values are 0, the second OR unit OR2 outputs 0.

The tenth AND unit AND10 receives the output value of the second OR unit OR2, the ACS signal, and the POL signal and when all three values are 1, the tenth AND unit AND10 outputs 1 and otherwise, the tenth AND unit AND10 outputs 0. The output value of the tenth AND unit AND10 is a switch control signal SW_PO3 which controls the third switch SW3 which connects the data line of the odd channel to the third positive voltage capacitor Cp3. When the output value of the tenth AND unit AND10 is 1, the third switch SW3 is closed.

The eleventh AND unit AND11 receives the output value of the second OR unit OR2, the ACS signal, and the POLb signal and when all three values are 1, the eleventh AND unit AND11 outputs 1 and otherwise, the eleventh AND unit AND11 outputs 0. The output value of the eleventh AND unit AND11 is a switch control signal SW_NO3 which controls the third switch SW3 which connects the data line of the odd channel to the third negative voltage capacitor Cn3. When the output value of the eleventh AND unit AND11 is 1, the third switch SW3 is closed.

The output values of the tenth AND unit AND10 and the eleventh AND unit AND11 are determined by the POL signal and the POLb signal so that the tenth AND unit AND10 and the eleventh AND unit AND11 do not simultaneously output 1.

A structure of a switch controller 573 of FIG. 8 is the same as the structure of FIG. 7 but the inputs of the POL signal and the POLb signal are different from each other. In other words, as compared with FIG. 7, in FIG. 8 the POL signal and the POLb signal are reversely input to the third AND unit AND3 and the fourth AND unit AND4, the POL signal and the POLb signal are reversely input to the sixth AND unit AND6 and the seventh AND unit AND7, and the POL signal and POLb signal are reversely input to the tenth AND unit AND10 and the eleventh AND unit AND11.

Accordingly, when the switch control signal SW_PO1 which controls the first switch SW1 which connects the data line of the odd channel to the first positive voltage capacitor Cp1 is output as 1, the switch control signal SW_NE1 which controls the first switch SW1 which connects the data line of the even channel to the first negative voltage capacitor Cn1 may be output as 1. When the switch control signal SW_PO2 which controls the second switch SW2 which connects the data line of the odd channel to the second positive voltage capacitor Cp2 is output as 1, the switch control signal SW_NE2 which controls the second switch SW2 which connects the data line of the even channel to the second negative voltage capacitor Cn2 may be output as 1. When the switch control signal SW_PO3 which controls the third switch SW3 which connects the data line of the odd channel to the third positive voltage capacitor Cp3 is output as 1, the switch control signal SW_NE3 which controls the third switch SW3 which connects the data line of the even channel to the third negative voltage capacitor Cn3 may be output as 1.

In other words, the second charge sharing is performed such that when any one of the odd channel and the even channel is connected to the positive voltage capacitors Cp1, Cp2, and Cp3, the other one is connected to the negative voltage capacitors Cn1, Cn2, and Cn3.

Referring back to FIG. 5, the voltage level shifter 574 includes first to sixth level shifters 574-1, 574-2, 574-3, 574-4, 574-5, and 574-6. The first level shifter 574-1 amplifies a level of the switch control signal SWP1 which controls the first switch SW1 which connects the data line to the first positive voltage capacitor Cp1 and outputs the amplified switch control signal SWP1. The second level shifter 574-2 amplifies a level of the switch control signal SWN1 which controls the first switch SW1 which connects the data line to the first negative voltage capacitor Cn1 and outputs the amplified switch control signal SWN1. The third level shifter 574-3 amplifies a level of the switch control signal SWP2 which controls the second switch SW2 which connects the data line to the second positive voltage capacitor Cp2 and outputs the amplified switch control signal SWP2. The fourth level shifter 574-4 amplifies a level of the switch control signal SWN2 which controls the second switch SW2 which connects the data line to the second negative voltage capacitor Cn2 and outputs the amplified switch control signal SWN2. The fifth level shifter 574-5 amplifies a level of the switch control signal SWP3 which controls the third switch SW3 which connects the data line to the third positive voltage capacitor Cp3 and outputs the amplified switch control signal SWP3. The sixth level shifter 574-6 amplifies a level of the switch control signal SWN3 which controls the third switch SW3 which connects the data line to the third negative voltage capacitor Cn3 and outputs the amplified switch control signal SWN3.

The amplified switch control signals are transmitted to the charge sharing operating unit 580 to perform the second charge sharing. The voltage of the data line may vary in various forms by the second charge sharing. According to the above-described exemplary embodiment of the present invention, the positive voltage of the data line may vary into 16 voltage changing types, which will be described with reference to FIGS. 9 to 24. The negative voltage of the data line is also varied into 16 voltage changing types, which has a reverse pattern to the voltage change of the data line of the positive voltage, and thus a detailed description thereof will be omitted.

FIGS. 9 to 24 are graphs illustrating a voltage change in accordance with charge sharing of a liquid crystal display according to an exemplary embodiment of the present invention.

Figure 9:
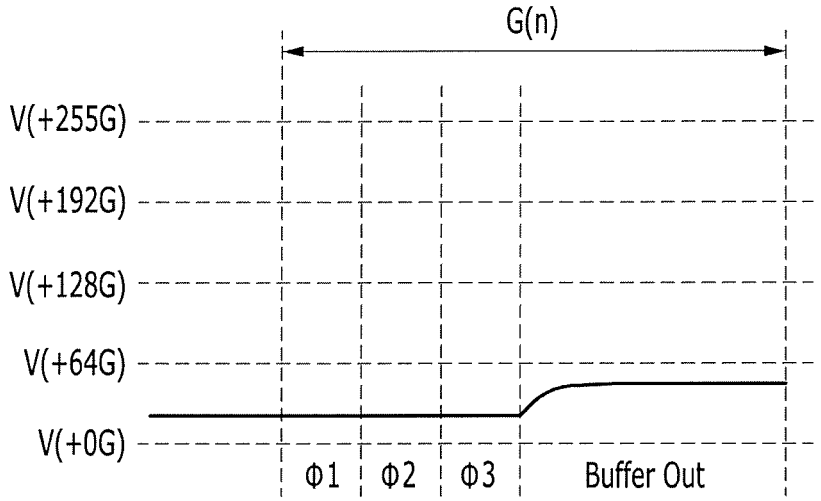
FIGS. 9, 10, 11, 12, 13, 14, 15, 16, 17, 18, 19, 20, 21, 22, 23 and 24 are graphs illustrating a voltage change in accordance with charge sharing of a liquid crystal display according to an exemplary embodiment of the present invention.

FIG. 9 illustrates a voltage change when MSB 2 bit values of the image data corresponding to a gate signal of a previous row is 00 and MSB 2 bit values of the image data corresponding to a gate signal of the present row is 00. When the MSB 2 bit value is 00, the data voltage is between 0 gray voltage V (+0G) and 64 gray voltage V (+64G). A difference of bit values is 0 so that there is no voltage change at the ACS time (e.g., Φ1, Φ2, Φ3).

Figure 10:
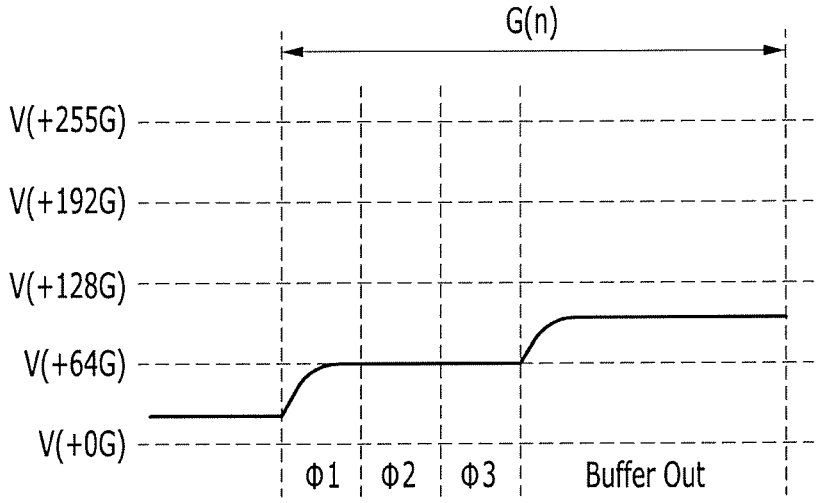

FIG. 10 illustrates a voltage change when the MSB 2 bit values of the image data corresponding to a gate signal of a previous row is 00 and the MSB 2 bit values of the image data corresponding to a gate signal of the present row is 01. When the MSB 2 bit value is 01, the data voltage is between the 64 gray voltage V (+64G) and 128 gray voltage V (+128G). A difference of bit values is +1, so that the voltage rises to the 64 gray voltage V (+64G) once by being synchronized with the first shift signal Φ1 at the ACS time (e.g., Φ1, Φ2, Φ3).

Figure 11:
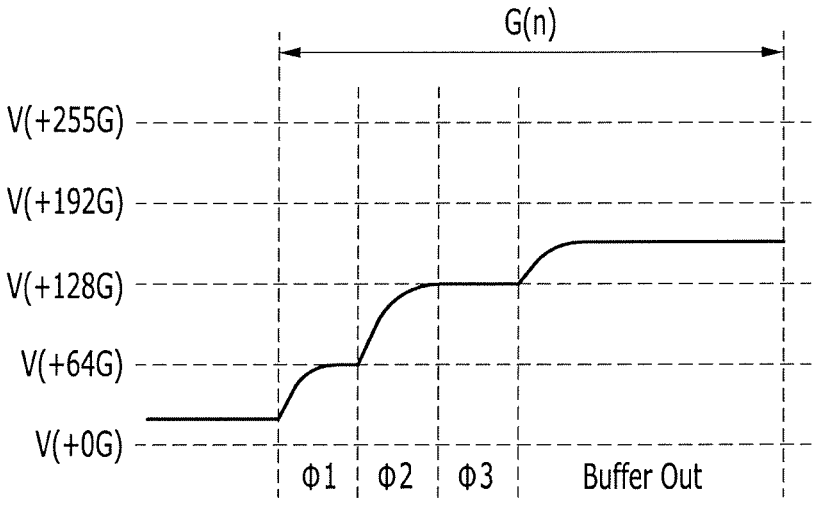

FIG. 11 illustrates a voltage change when the MSB 2 bit values of the image data corresponding to a gate signal of a previous row is 00 and the MSB 2 bit values of the image data corresponding to a gate signal of the present row is 10. When the MSB 2 bit value is 10, the data voltage is between the 128 gray voltage V (+128G) and 192 gray voltage V (+192G). A difference of bit values is +2, so that the voltage rises to the 64 gray voltage V (+64G) and the 128 gray voltage V(+128G) two times by being synchronized with the first shift signal Φ1 and the second shift signal Φ2 at the ACS time (e.g., Φ1, Φ2, Φ3).

Figure 12:
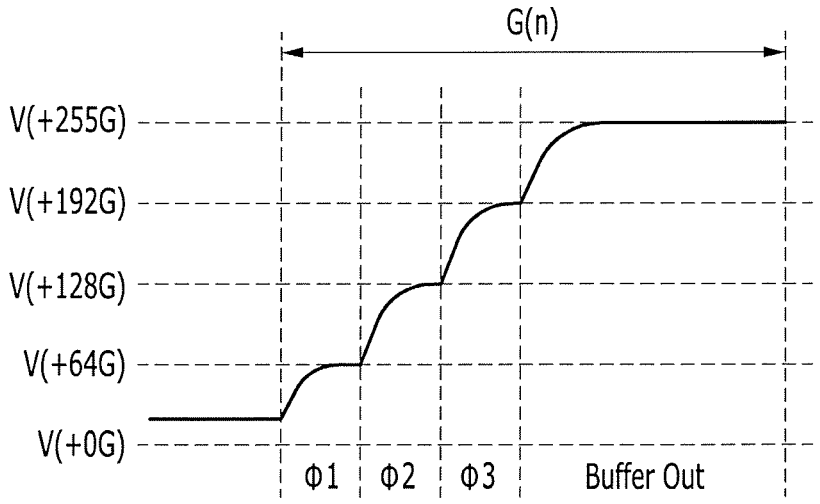

FIG. 12 illustrates a voltage change when the MSB 2 bit values of the image data corresponding to a gate signal of a previous row is 00 and the MSB 2 bit values of the image data corresponding to a gate signal of the present row is 11. When the MSB 2 bit value is 11, the data voltage is between the 192 gray voltage V (+192G) and 255 gray voltage V (+255G). A difference of bit values is +3, so that the voltage rises to the 64 gray voltage V (+64G), the 128 gray voltage V (+128G) and the 192 gray voltage V(+192G) three times by being synchronized with the first shift signal Φ1, the second shift signal Φ2, and the third shift signal Φ3 at the ACS time (e.g., Φ1, Φ2, Φ3).

Figure 13:
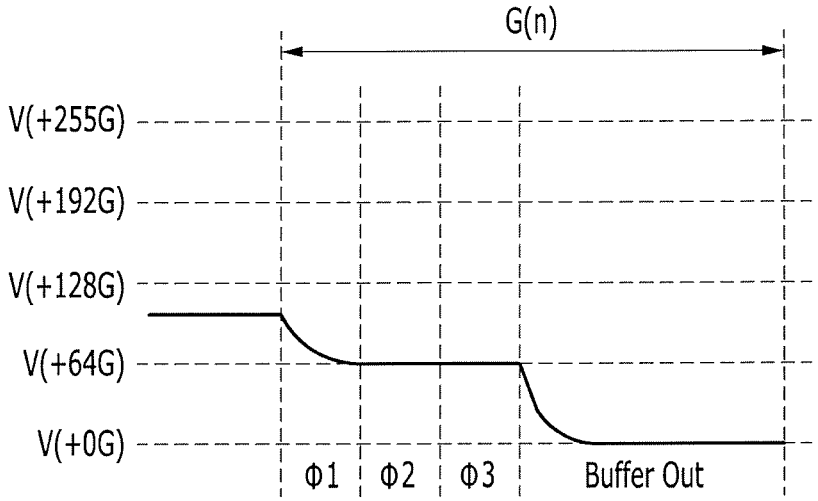

FIG. 13 illustrates a voltage change when the MSB 2 bit values of the image data corresponding to a gate signal of a previous row is 01 and the MSB 2 bit values of the image data corresponding to a gate signal of the present row is 00. A difference of bit values is −1, so that the voltage drops to the 64 gray voltage V (+64G) once by being synchronized with the first shift signal Φ1 at the ACS time (e.g., Φ1, Φ2, Φ3).

Figure 14:
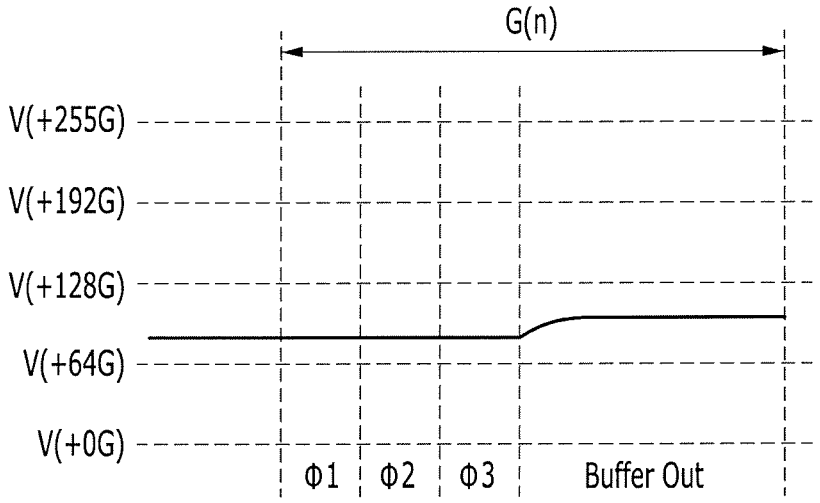

FIG. 14 illustrates a voltage change when the MSB 2 bit values of the image data corresponding to a gate signal of a previous row is 01 and the MSB 2 bit values of the image data corresponding to a gate signal of the present row is 01. A difference of bit values is 0 so that there is no voltage change at the ACS time (e.g., Φ1, Φ2, Φ3).

Figure 15:
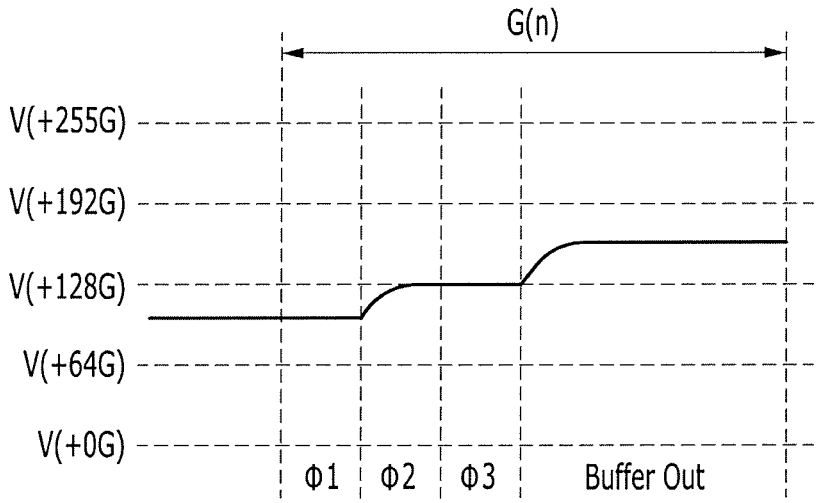

FIG. 15 illustrates a voltage change when the MSB 2 bit values of the image data corresponding to a gate signal of a previous row is 01 and the MSB 2 bit values of the image data corresponding to a gate signal of the present row is 10. A difference of bit values is +1, so that the voltage rises to the 128 gray voltage V (+128G) once by being synchronized with the second shift signal Φ2 at the ACS time (e.g., Φ1, Φ2, Φ3).

Figure 16:
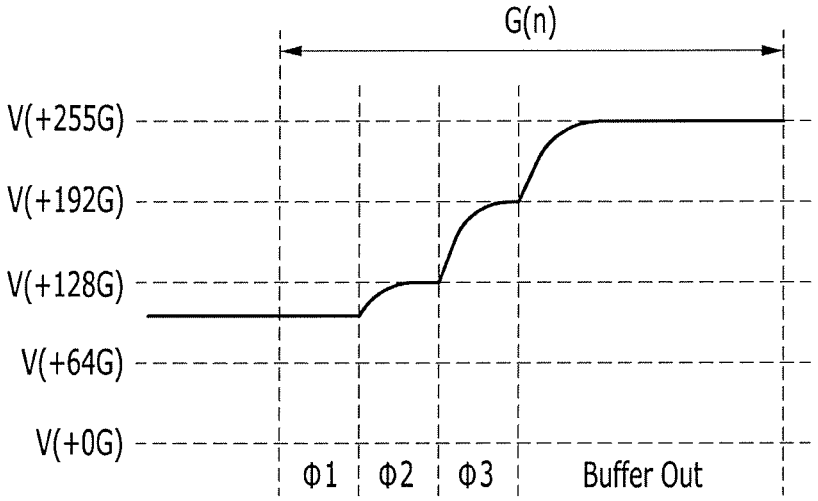

FIG. 16 illustrates a voltage change when the MSB 2 bit values of the image data corresponding to a gate signal of a previous row is 01 and the MSB 2 bit values of the image data corresponding to a gate signal of the present row is 11. A difference of bit values is +2, so that the voltage rises to the 128 gray voltage V (+128G) and the 192 gray voltage V(+192G) two times by being synchronized with the second shift signal Φ2 and the third shift signal Φ3 at the ACS time (e.g., Φ1, Φ2, Φ3).

Figure 17:
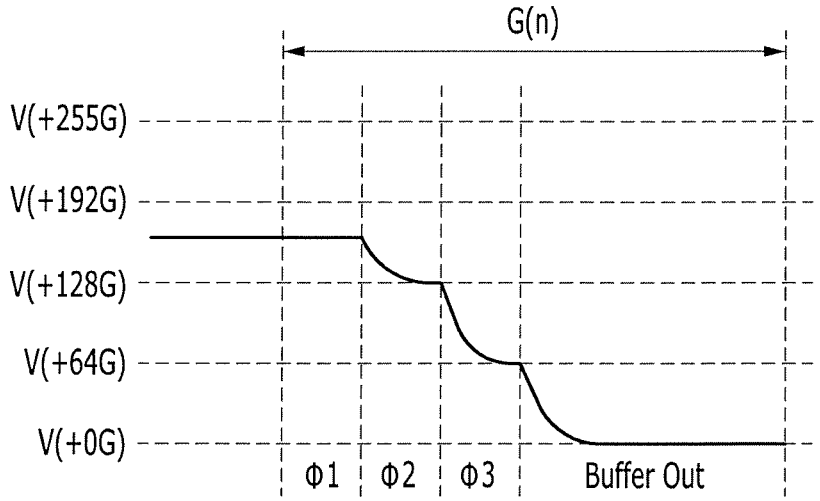

FIG. 17 illustrates a voltage change when the MSB 2 bit values of the image data corresponding to a gate signal of a previous row is 10 and the MSB 2 bit values of the image data corresponding to a gate signal of the present row is 00. A difference of bit values is −2, so that the voltage drops to the 128 gray voltage V (+128G) and the 64 gray voltage V(+64G) two times by being synchronized with the second shift signal Φ2 and the third shift signal Φ3 at the ACS time (e.g., Φ1, Φ2, Φ3).

Figure 18:
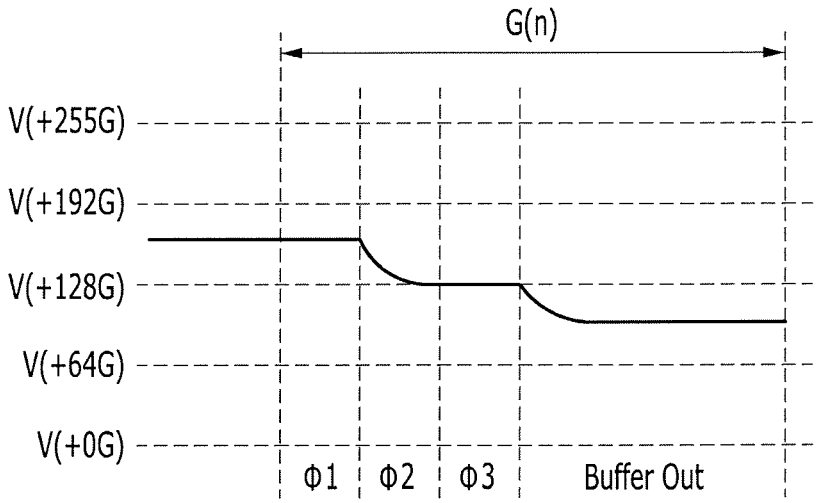

FIG. 18 illustrates a voltage change when the MSB 2 bit values of the image data corresponding to a gate signal of a previous row is 10 and the MSB 2 bit values of the image data corresponding to a gate signal of the present row is 01. A difference of bit values is −1, so that the voltage drops to the 128 gray voltage V (+128G) once by being synchronized with the second shift signal Φ2 at the ACS time (e.g., Φ1, Φ2, Φ3).

Figure 19:
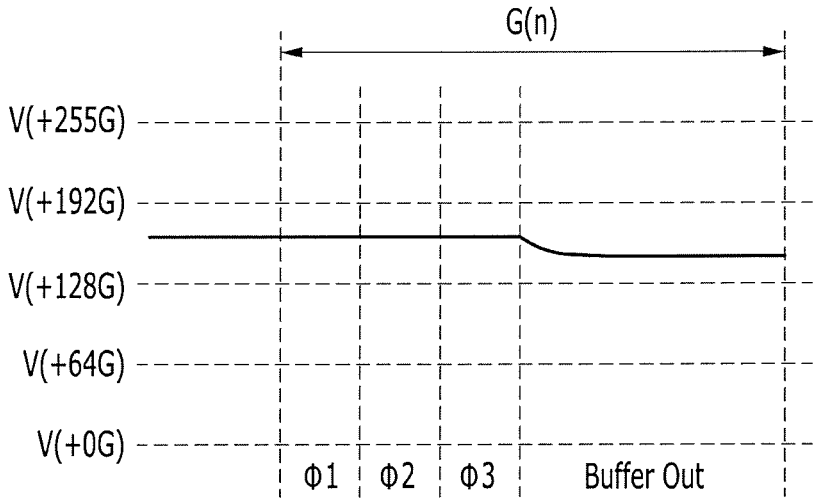

FIG. 19 illustrates a voltage change when the MSB 2 bit values of the image data corresponding to a gate signal of a previous row is 10 and the MSB 2 bit values of the image data corresponding to a gate signal of the present row is 10. A difference of bit values is 0 so that there is no voltage change at the ACS time (e.g., Φ1, Φ2, Φ3).

Figure 20:
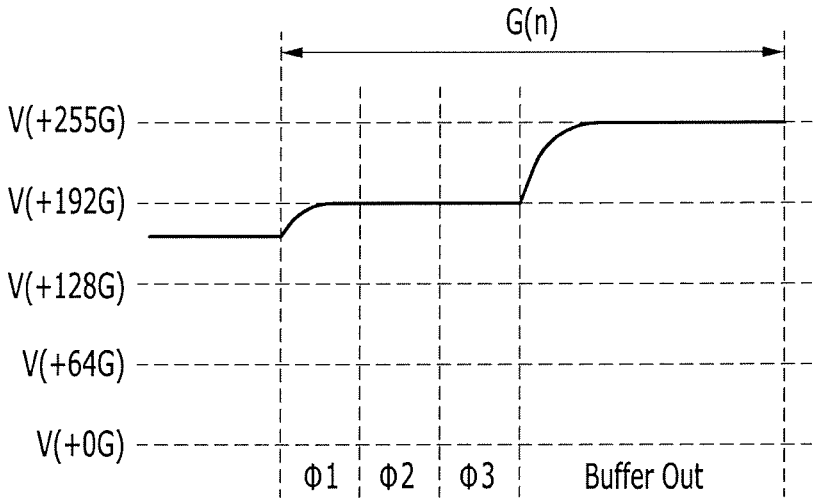

FIG. 20 illustrates a voltage change when the MSB 2 bit values of the image data corresponding to a gate signal of a previous row is 10 and the MSB 2 bit values of the image data corresponding to a gate signal of the present row is 11. A difference of bit values is +1, so that the voltage rises to the 192 gray voltage V (+192G) once by being synchronized with the first shift signal Φ1 at the ACS time (e.g., Φ1, Φ2, Φ3).

Figure 21:
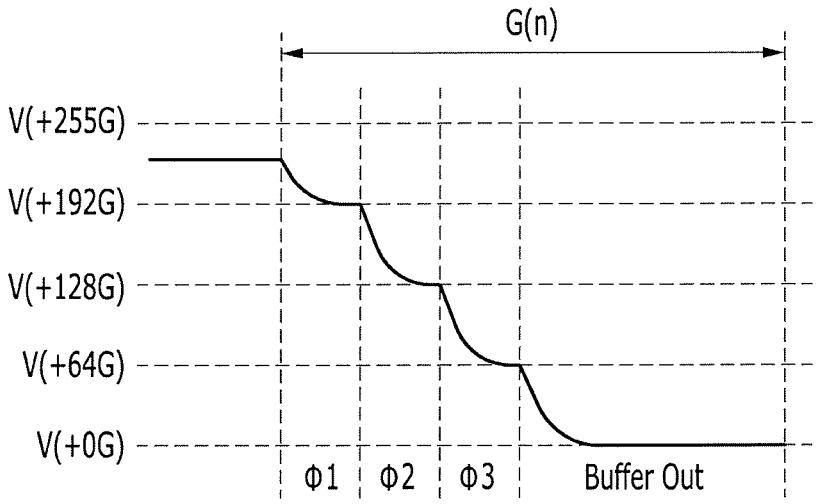

FIG. 21 illustrates a voltage change when the MSB 2 bit values of the image data corresponding to a gate signal of a previous row is 11 and the MSB 2 bit values of the image data corresponding to a gate signal of the present row is 00. A difference of bit values is −3, so that the voltage drops to the 192 gray voltage V (+192G), the 128 gray voltage V(+128G), and the 64 gray voltage V (+64G) three times by being synchronized with the first shift signal Φ1, the second shift signal Φ2, and the third shift signal Φ3 at the ACS time (e.g., Φ1, Φ2, Φ3).

Figure 22:
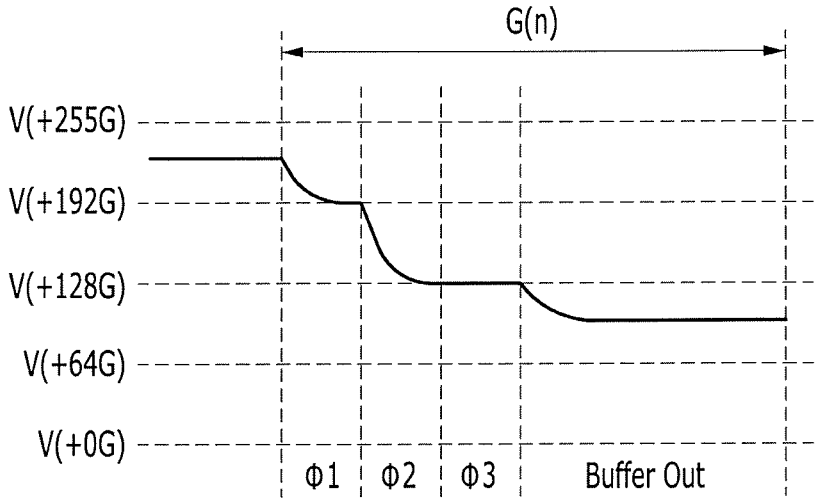

FIG. 22 illustrates a voltage change when the MSB 2 bit values of the image data corresponding to a gate signal of a previous row is 11 and the MSB 2 bit values of the image data corresponding to a gate signal of the present row is 01. A difference of bit values is −2, so that the voltage drops to the 192 gray voltage V (+192G) and the 128 gray voltage V(+128G) two times by being synchronized with the first shift signal Φ1 and the second shift signal Φ2 at the ACS time (e.g., Φ1, Φ2, Φ3).

Figure 23:
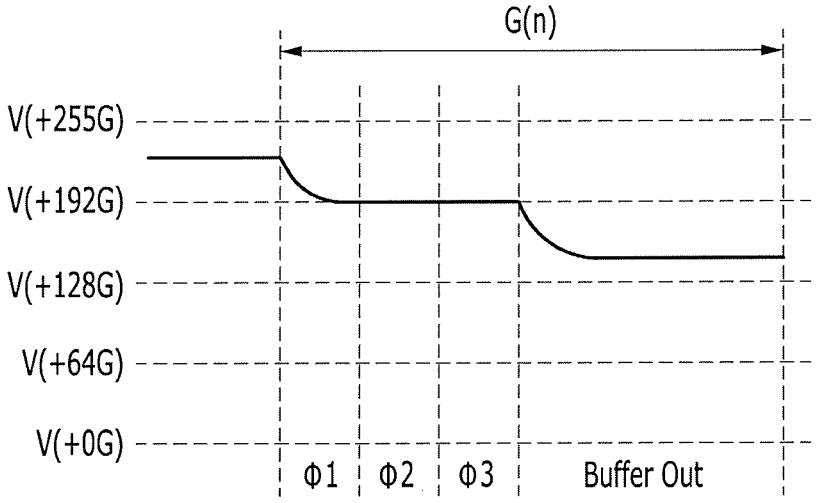

FIG. 23 illustrates a voltage change when the MSB 2 bit values of the image data corresponding to a gate signal of a previous row is 11 and the MSB 2 bit values of the image data corresponding to a gate signal of the present row is 10. A difference of bit values is −1, so that the voltage drops to the 192 gray voltage V (+192G) once by being synchronized with the first shift signal Φ1 at the ACS time (e.g., Φ1, Φ2, Φ3).

Figure 24:
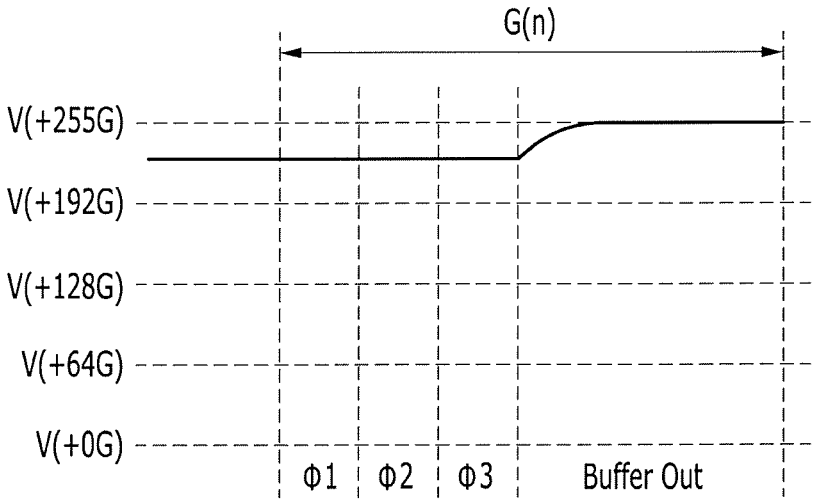

FIG. 24 illustrates a voltage change when the MSB 2 bit values of the image data corresponding to a gate signal of a previous row is 11 and the MSB 2 bit values of the image data corresponding to a gate signal of the present row is 11. A difference of bit values is 0, so that there is no voltage change at the ACS time (e.g., Φ1, Φ2, Φ3).

Hereinafter, a data driver according to an exemplary embodiment will be described with reference to FIGS. 25 to 27.

Figure 25:
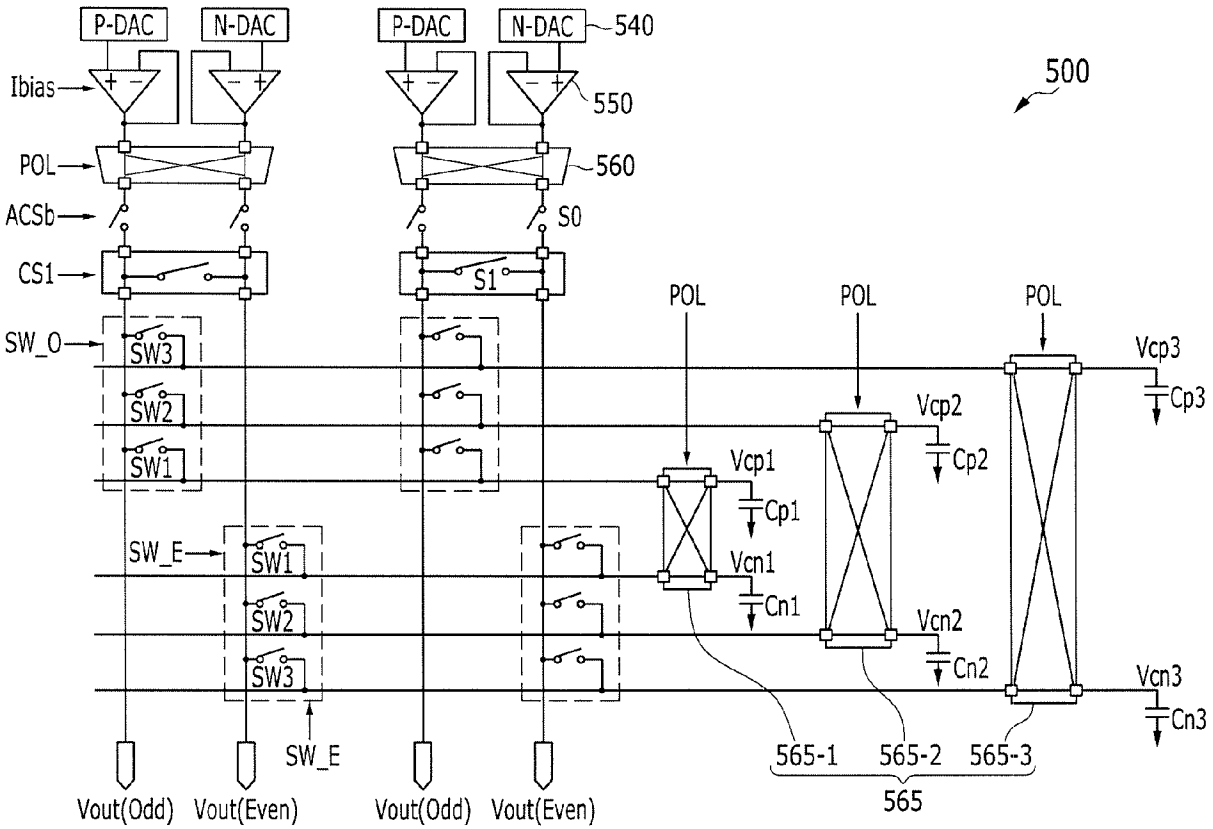
FIG. 25 is a block diagram illustrating a data driver of a liquid crystal display according to an exemplary embodiment of the present invention.

FIG. 25 is a block diagram illustrating a data driver of a liquid crystal display according to an exemplary embodiment of the present invention. FIGS. 26 and 27 are block diagrams illustrating a switch controller included in the data driver of the liquid crystal display of FIG. 25, according to an exemplary embodiment of the present invention.

As compared with FIG. 2, in the data driver 500 of FIG. 25, a charge sharing path selecting unit 565 is added between switches SW1, SW2, and SW3 for second charge sharing and the capacitors Cp1, Cp2, Cp3, Cn1, Cn2, and Cn3 and half of the switches SW1, SW2, and SW3 for second charge sharing is removed in the odd channel and the even channel. In other words, the positive voltage switch may be disposed in the odd data line and the negative voltage switch may be disposed in the even data line.

The charge sharing path selecting unit 565 includes a first selector 565-1, a second selector 565-2, and a third selector 565-3. The first selector 565-1 connects any one of the first positive voltage capacitor Cp1 and the first negative voltage capacitor Cn1 to the odd channel and connects the other one to the even channel in accordance with the POL signal. The second selector 565-2 connects any one of the second positive voltage capacitor Cp2 and the second negative voltage capacitor Cn2 to the odd channel and connects the other one to the even channel in accordance with the POL signal. The third selector 565-3 connects any one of the third positive voltage capacitor Cp3 and the third negative voltage capacitor Cn3 to the odd channel and connects the other one to the even channel in accordance with the POL signal.

By adding the charge sharing path selecting unit 565, the number of switches SW1, SW2, and SW3 is reduced by ½, the number of level shifters which are included in the voltage level shifter 574 is reduced by ½, and a size of the source IC which drives the switches SW1, SW2, and SW3 may be reduced.

Figure 26:
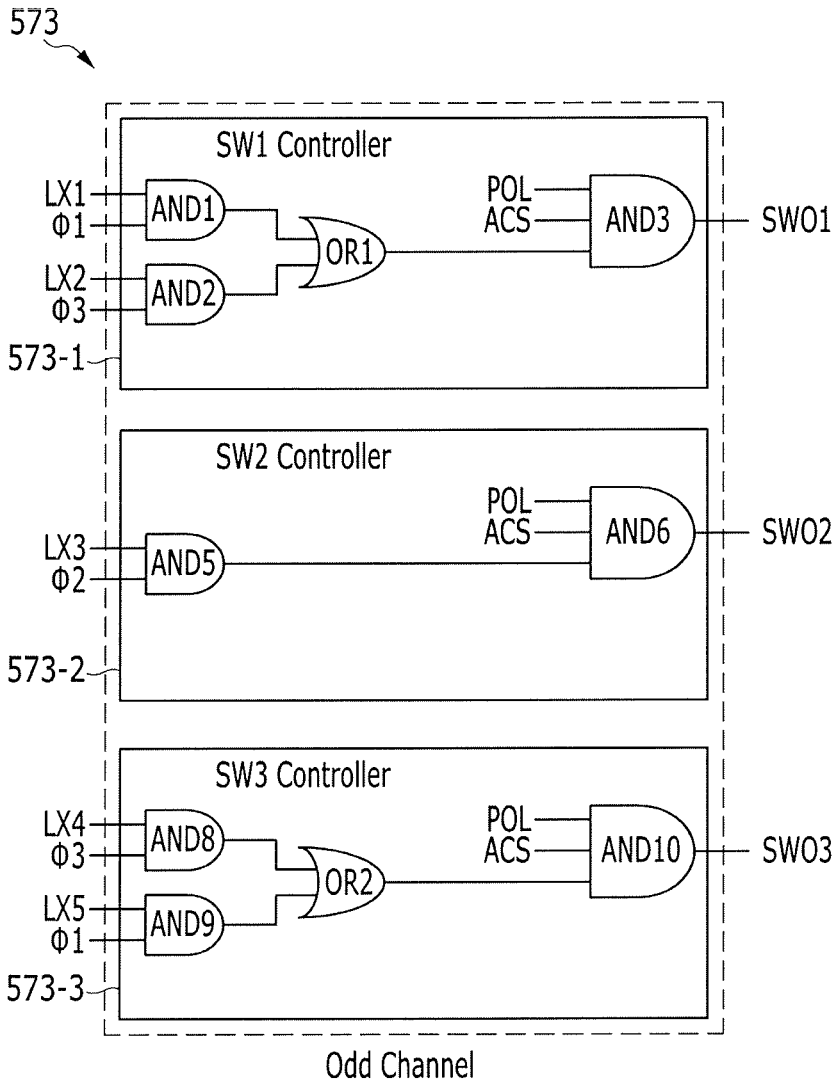
FIGS. 26 and 27 are block diagrams illustrating a switch controller included in the data driver of the liquid crystal display of FIG. 25, according to an exemplary embodiment of the present invention.
Figure 27:
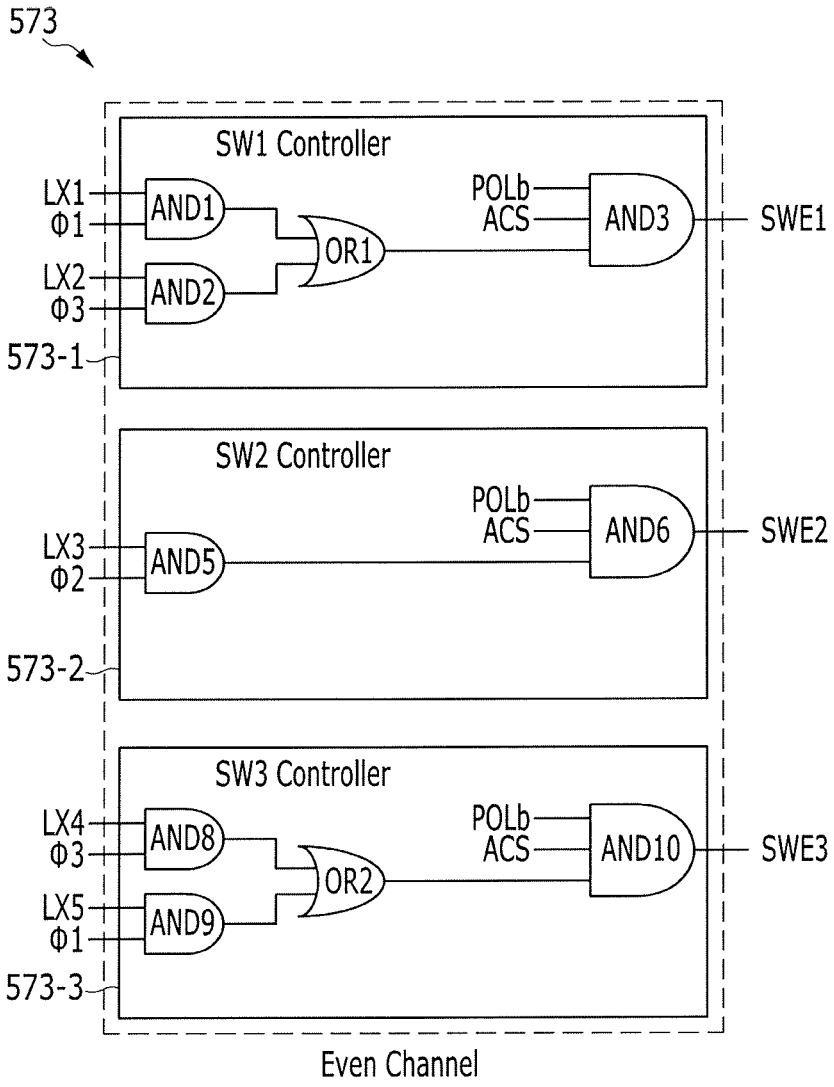

Further, by adding the charge sharing path selecting unit 565, as illustrated in FIGS. 26 and 27, the switch controller 573 generates only switch control signals SWO1, SWO2, and SWO3 of the odd channel and switch control signals SWE1, SWE2, and SWE3 of the even channel, regardless of the polarity of the data voltage.

As compared with FIGS. 7 and 8, in the switch controller 573 of the odd channel and the even channel of FIGS. 26 and 27, the fourth AND unit AND4, the seventh AND unit AND7, and the eleventh AND unit AND11 are omitted.

Hereinafter, a data driver according to an exemplary embodiment will be described with reference to FIGS. 28 and 29.

Figure 28:
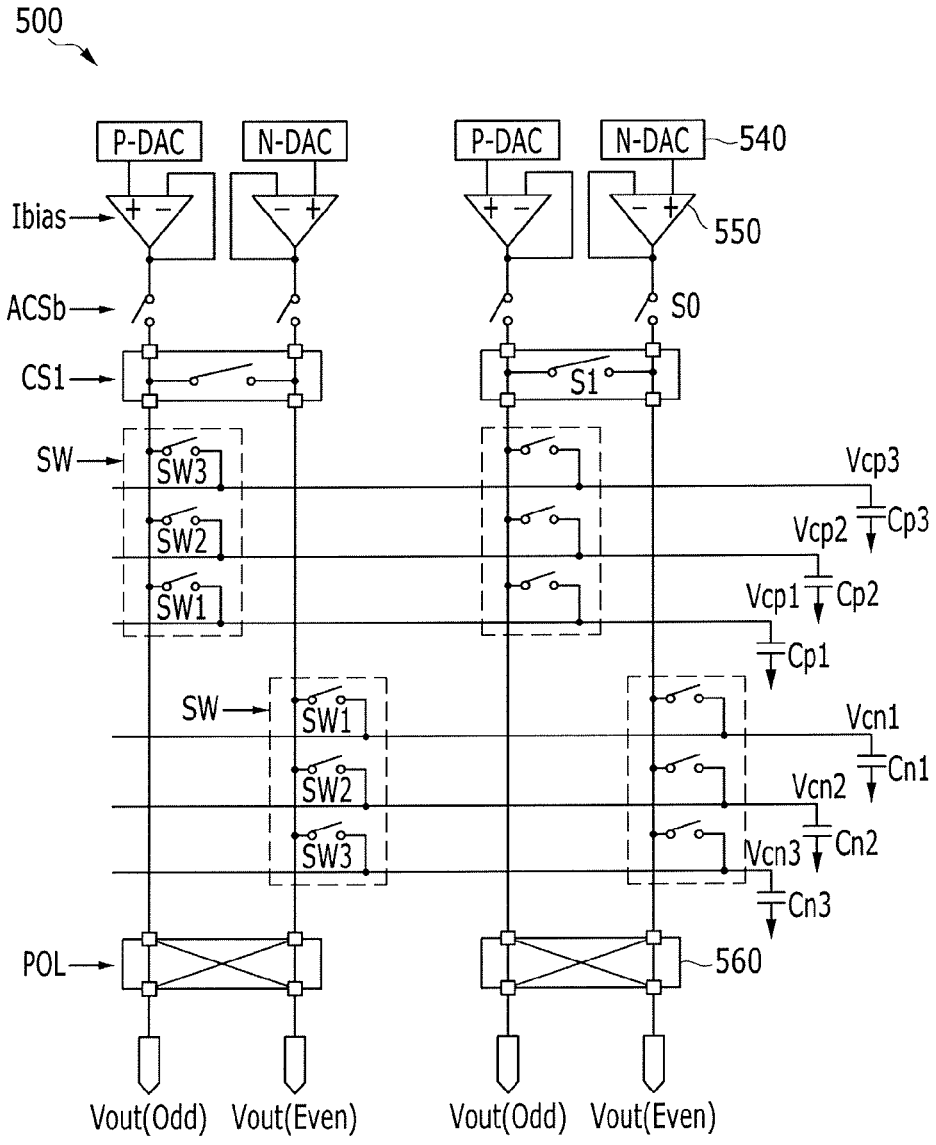
FIG. 28 is block diagram illustrating a data driver of a liquid crystal display according to an exemplary embodiment of the present invention.

FIG. 28 is block diagram illustrating a data driver of a liquid crystal display according to an exemplary embodiment of the present invention. FIG. 29 is a block diagrams illustrating a switch controller included in the data driver of the liquid crystal display of FIG. 28, according to an exemplary embodiment of the present invention.

As compared with FIG. 2, in the data driver 500 of FIG. 28, the MUX unit 560 is located immediately before the output terminal (Vout(Odd) and Vout(Even) of the data driver 500 and half of the switches SW1, SW2, and SW3 for second charge sharing is removed from the odd channel and the even channel. The MUX unit 560 is disposed next to the switches SW1, SW2, and SW3 for the second charge sharing. The MUX unit 560 is located immediately before the output terminal Vout(Odd) and Vout(Even) so that the voltage range between the amplifier 550 and the MUX unit 560 has the same polarity all of the time, thereby reducing the voltage range used for the operation of switches SW1, SW2, and SW3 by ½. Therefore, power consumption of the level shifter (e.g., 574 of FIG. 6) which amplifies the switch control signal may be reduced.

Figure 29:
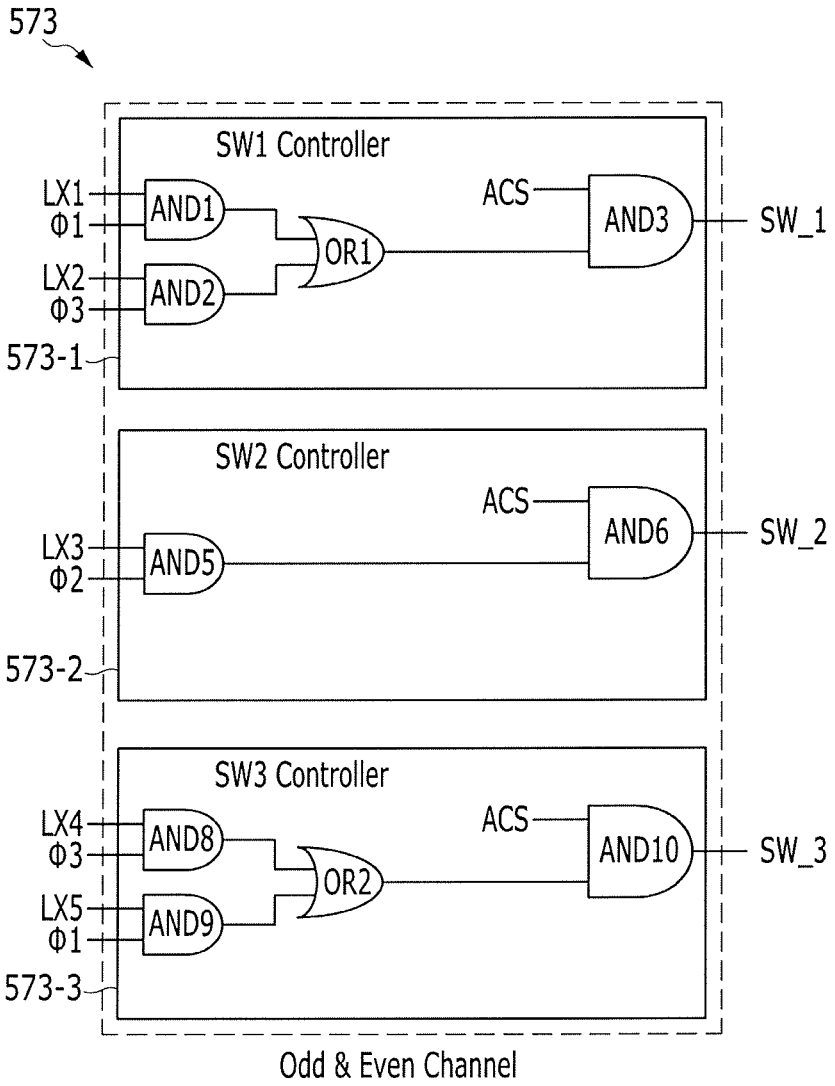
FIG. 29 is a block diagrams illustrating a switch controller included in the data driver of the liquid crystal display of FIG. 28, according to an exemplary embodiment of the present invention.

Further, the MUX unit 560 is located immediately before the output terminal Vout(Odd) and Vout(Even) of the data driver 500, so that as illustrated in FIG. 29, the switch controller 573 may generate switch control signals SW_1, SW_2, and SW_3 regardless of the polarity of the data voltage, the odd channel, and the even channel.

As compared with FIGS. 7 and 8, in the switch controller 573 of FIG. 29, the fourth AND unit AND4, the seventh AND unit AND7, and the eleventh AND unit AND11 are omitted and the POL signal is not input to the third AND unit AND3, the sixth AND unit AND6, and the tenth AND unit AND10.

An exemplary embodiment of the present invention provides a liquid crystal display which performs inversion driving while preventing power consumption from being increased and a driving method thereof.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display, comprising:

a liquid crystal panel which includes a plurality of pixels and a plurality of data lines connected to the plurality of pixels; and a data driver which applies data voltages having different polarities to adjacent data lines among the plurality of data lines and performs a first charge sharing to short the data lines having the different polarities and a second charge sharing to short the data lines having the same polarity, wherein the voltage of at least one of the data lines is step-wisely changed by the second charge sharing, wherein:

the data driver includes:

a plurality of positive voltage switches which connects a plurality of positive voltage capacitors to the at least one data line having a positive voltage to perform the second charge sharing; and a plurality of negative voltage switches which connects a plurality of negative voltage capacitors to the at least one data line having a negative voltage to perform the second charge sharing, wherein:

the data driver further includes a most significant bit (MSB) latch which stores 2 bits of an MSB (MSB 2 bit) of image data and outputs the MSB 2 bit of the image data corresponding to a stored gate signal of a previous row, and MSB 2 bit of the image data corresponding to a gate signal in a present row, a variation detecting unit which compares the MSB 2 bit of the image data corresponding to the gate signal of the previous row with the MSB 2 bit of the image data corresponding to the gate signal of the present row to detect a voltage change in the plurality of data lines; and a switch controller which generates a switch control signal to control the plurality of positive voltage switches and the plurality of negative voltage switches which connect the plurality of positive voltage capacitors and the plurality of negative voltage capacitors to the plurality of data lines in accordance with the voltage change.

2. The liquid crystal display of claim 1, wherein:

the data driver includes:

a digital-to-analog converter (DAC) unit which converts a digital image signal into an analog data voltage;

an amplifier which amplifies the data voltage; and a multiplexer (MUX) unit which adjusts the data voltage in accordance with a polarity to be applied to the at least one data line in response to an inversion signal.

3. The liquid crystal display of claim 2, wherein:

the plurality of positive voltage switches and the plurality of negative voltage switches are disposed next to the MUX unit.

4. The liquid crystal display of claim 2, wherein:

the plurality of positive voltage switches and the plurality of negative voltage switches are disposed in each of the plurality of data lines.

5. The liquid crystal display of claim 1, wherein:

the plurality of positive voltage capacitors and the plurality of negative voltage capacitors have different voltages.

6. The liquid crystal display of claim 1, wherein:

the variation detecting unit includes a plurality of logic circuits which outputs a plurality of logic values to control the plurality of positive voltage switches and the plurality of negative voltage switches in accordance with a bit value output from the MSB latch.

7. The liquid crystal display of claim 6, wherein:

the switch controller includes a first AND unit which receives a first logic value and a first phase signal which divides a plurality of sections in which the at least one data line is step-wisely changed;

a second AND unit which receives a second logic value and a third phase signal which divides the plurality of sections;

a first OR unit which compares output values of the first AND unit and the second AND unit to output 1 when at least one of the output values is 1; and a third AND unit which receives an output value of the first OR unit and an ACS signal to output a first switch control signal, wherein the ACS signal instructs the second charge sharing to be performed.

8. The liquid crystal display of claim 7, wherein:

the third AND unit further receives a polarity inversion signal to output the first switch control signal.

9. The liquid crystal display of claim 8, wherein:

the switch controller further includes a fourth AND unit which receives the output value of the first OR unit, the ACS signal, and a reverse signal of the polarity inversion signal to output the second switch control signal.

10. The liquid crystal display of claim 7, wherein:

the switch controller further includes:

a fifth AND unit which receives a third logic value and a second phase signal which divides the plurality of sections; and a sixth AND unit which receives an output value of the fifth AND unit and the ACS signal to output the second switch control signal.

11. The liquid crystal display of claim 10, wherein:

the sixth AND unit further receives a polarity inversion signal to output the second switch control signal.

12. The liquid crystal display of claim 11, wherein:

the switch controller further includes a seventh AND unit which receives an output value of the fifth AND unit, the ACS signal, and a reverse signal of the polarity inversion signal to output a third switch control signal.

13. A liquid crystal display, comprising:

a liquid crystal panel which includes a plurality of pixels and a plurality of data lines connected to the plurality of pixels; and a data driver which applies data voltages having different polarities to adjacent data lines among the plurality of data lines and performs a first charge sharing to short the data lines having the different polarities and a second charge sharing to short the data lines having the same polarity, wherein the voltage of at least one of the data lines is step-wisely changed by the second charge sharing, wherein:

the data driver includes:

a plurality of positive voltage switches which connects a plurality of positive voltage capacitors to the at least one data line having a positive voltage to perform the second charge sharing; and a plurality of negative voltage switches which connects a plurality of negative voltage capacitors to the at least one data line having a negative voltage to perform the second charge sharing, wherein:

the data driver further includes a path selecting unit disposed between the plurality of positive voltage switches and the plurality of positive voltage capacitors and between the plurality of negative voltage switches and the plurality of negative voltage capacitors.

14. The liquid crystal display of claim 13, wherein:

the plurality of positive voltage switches is disposed in at least one of odd data lines and even data lines and the plurality of negative voltage switches is disposed in at least one of the other odd data lines and even data lines.

15. A driving method of a liquid crystal display, comprising:

applying data voltages having different polarities to adjacent data lines among a plurality of data lines connected to a plurality of pixels;

performing a first charge sharing which shorts the data lines having different polarities from each other; and performing a second charge sharing which shorts the data lines having the same polarity as each other, wherein the voltage of at least one of the data lines is step-wisely changed by the second charge sharing, the driving method further comprising:

storing 2 bits of a most significant bit (MSB) (MSB 2 bit) of image data and outputting the MSB 2 bit of the image data corresponding to a stored gate signal of a previous row, and MSB 2 bit of the image data corresponding to a gate signal in a present row;

comparing the MSB 2 bit of the image data corresponding to the gate signal of the previous row with the MSB 2 bit of the image data corresponding to the gate signal of the present row to detect a voltage change in the plurality of data lines; and generating a switch control signal to control a plurality of positive voltage switches and a plurality of negative voltage switches which connect a plurality of positive voltage capacitors and a plurality of negative voltage capacitors to the plurality of data lines in accordance with the voltage change.

16. The driving method of claim 15, wherein:

the first charge sharing and the second charge sharing do not overlap.

17. A liquid crystal display, comprising:

a plurality of data lines; and a data driver which shorts the data lines having different polarities and shorts the data lines having the same polarity, wherein the data lines having the different polarities are shorted in a first charge sharing and the data lines having the same polarity are shorted in a second charge sharing, wherein the data driver includes a first switch for the first charge sharing and a plurality of second switches for the second charge sharing, wherein the plurality of second switches increase or decrease a voltage of at least one of the data lines during the second charge sharing, wherein:

the plurality of second switches includes:

a plurality of positive voltage switches which connects a plurality of positive voltage capacitors to the at least one data line having a positive voltage to perform the second charge sharing; and a plurality of negative voltage switches which connects a plurality of negative voltage capacitors to the at least one data line having a negative voltage to perform the second charge sharing, wherein:

the data driver further includes a path selecting unit disposed between the plurality of positive voltage switches and the plurality of positive voltage capacitors and between the plurality of negative voltage switches and the plurality of negative voltage capacitors.

* * * * *